US005722283A

United States Patent [19]

VanderZee et al.

[11] Patent Number: 5,722,283

[45] Date of Patent: Mar. 3, 1998

[54] SYSTEM AND METHOD FOR ROTATION OF CROSS BARS IN A MULTIPLE STATION TRANSFER PRESS

[75] Inventors: Allen J. VanderZee, St. John, Ind.; Edward J. Brzezniak; Adam Schwarz, both of Orland Park, Ill.

[73] Assignee: Verson, A Divison of Allied Products Corporation, Chicago, Ill.

[21] Appl. No.: 618,451

[22] Filed: Mar. 14, 1996

Related U.S. Application Data

[63] Continuation-in-part of Ser. No. 393,554, Feb. 23, 1995, Pat. No. 5,632,181.

[51] Int. Cl.[6] ..... B21D 43/05

[52] U.S. Cl. ..... 72/405.1; 72/405.01

[58] Field of Search ..... 72/405.16, 405.15, 72/405.13, 405.11, 405.1, 405.01, 421

[56] References Cited

U.S. PATENT DOCUMENTS

| | | | |
|---|---|---|---|
| 1,959,512 | 5/1934 | Wall et al. | 25/1 |
| 2,763,229 | 9/1956 | Sahlin | 113/50 |
| 2,867,185 | 1/1959 | Hayward | 113/50 |
| 2,941,799 | 6/1960 | Reincke | 271/27 |
| 3,101,941 | 8/1963 | Reincke | 271/27 |
| 3,178,040 | 4/1965 | Nelson | 214/1 |
| 3,179,262 | 4/1965 | Carlson, Sr. et al. | 214/1 |
| 3,269,723 | 8/1966 | Staines | 271/27 |
| 3,855,840 | 12/1974 | Kawano | 72/418 |
| 3,875,808 | 4/1975 | Okamoto et al. | 74/29 |
| 3,937,056 | 2/1976 | Henzler et al. | 72/405 |
| 3,937,457 | 2/1976 | Schwebel | 271/92 |
| 4,189,136 | 2/1980 | Robinette | 271/12 |
| 4,279,561 | 7/1981 | Schneider et al. | 414/591 |
| 4,428,221 | 1/1984 | Owens | 72/405 |
| 4,509,356 | 4/1985 | Budrean et al. | 72/349 |
| 4,523,889 | 6/1985 | Orii | 414/752 |

(List continued on next page.)

FOREIGN PATENT DOCUMENTS

| | | |
|---|---|---|
| 325841 | 2/1989 | European Pat. Off. . |
| 4001590 | 8/1990 | Germany . |
| 4001591 | 8/1990 | Germany . |
| 198164 | 6/1983 | Japan . |

(List continued on next page.)

OTHER PUBLICATIONS

Stegman, *Motion Control Technology AG 626 Configurable Multi–turn Absolute Angle Encoder,* 1994. (4 pgs.).

Brochure, Custom Servo Motor, Inc., *MaxPlus Motors and Equipment,* no date. (2 pgs.).

William G. Anderson, *NdFeB Magnet Material in High Performance Brushless Servo Motors,* 1992. (5 pgs.).

*Primary Examiner*—Daniel C. Crane

*Attorney, Agent, or Firm*—Baker & Botts, L.L.P.

[57] ABSTRACT

A multiple station transfer press (20) is provided. The cross bar assemblies (42) transfer work pieces (22) between adjacent press stations (24) in transfer press (10). Movement of the cross bar assemblies (42) is provided by raising and lowering transfer rails (38) and (40) along with reciprocating cross bar assemblies (42) along transfer rails (38) and (40). Each cross bar assembly (42) can also be tilted and/or tipped relative to the transfer rails (38 and 40). Cross bar assemblies (42) are used to dynamically orient work pieces (22) during transfer between adjacent press stations (24). A portion of the motion of each cross bar assembly (42) occurs while upper dies (36) and lower dies (34) are separated by less than a maximum distance. The cross bar assemblies (42) preferably include at least two cross bars (130, 132) which may be rotated one hundred and eighty degrees to accommodate changing holding devices such as suction cups (268, 270) while changing dies (36, 34). The cross bars (130, 132) may also be independently rotated relative to each other and the associated cross bar assembly (42) to accommodate specific dies (36, 34) and/or work pieces (22) which are best engaged by holding devices (268, 270) oriented with a specific polar rotation relative to the longitudinal axis (384) of the respective cross bar (130, 132).

29 Claims, 17 Drawing Sheets

U.S. PATENT DOCUMENTS

| | | | |
|---|---|---|---|
| 4,559,802 | 12/1985 | Budrean et al. | 72/349 |
| 4,562,719 | 1/1986 | Budrean et al. | 72/349 |
| 4,566,306 | 1/1986 | Orii | 72/346 |
| 4,625,540 | 12/1986 | Yamada et al. | 72/405 |
| 4,625,850 | 12/1986 | Marsh | 192/143 |
| 4,634,338 | 1/1987 | Tsuge et al. | 414/752 |
| 4,641,515 | 2/1987 | Braun et al. | 72/405 |
| 4,648,786 | 3/1987 | Sakurai | 414/752 |
| 4,658,626 | 4/1987 | Yamada et al. | 72/405 |
| 4,682,685 | 7/1987 | Yamada et al. | 198/621 |
| 4,697,448 | 10/1987 | Stevens, Jr. et al. | 72/405 |
| 4,713,961 | 12/1987 | Hoehn et al. | 72/419 |
| 4,730,825 | 3/1988 | Mikusch et al. | 271/268 |
| 4,732,376 | 3/1988 | Umezawa | 271/267 |
| 4,754,955 | 7/1988 | Otsuka et al. | 267/119 |
| 4,807,456 | 2/1989 | Shiraishi | 72/405 |
| 4,848,764 | 7/1989 | Tajima et al. | 271/90 |
| 4,866,974 | 9/1989 | Shiraishi et al. | 72/405 |
| 4,929,164 | 5/1990 | Duina | 425/145 |
| 4,941,793 | 7/1990 | Shiraishi | 414/225 |
| 4,958,824 | 9/1990 | Willits et al. | 271/11 |
| 4,981,031 | 1/1991 | Schneider et al. | 72/405 |
| 4,995,505 | 2/1991 | Takahashi et al. | 198/468.4 |
| 5,001,921 | 3/1991 | Schneider et al. | 72/405 |
| 5,029,836 | 7/1991 | Swaneck | 271/107 |
| 5,031,441 | 7/1991 | Jones | 72/420 |
| 5,048,318 | 9/1991 | Thudium et al. | 72/405 |
| 5,054,306 | 10/1991 | Brzezniak | 72/405 |
| 5,064,183 | 11/1991 | Nishigaki et al. | 271/10 |
| 5,072,823 | 12/1991 | Takahashi et al. | 198/468.4 |
| 5,097,695 | 3/1992 | Brzezniak | 72/405 |
| 5,103,965 | 4/1992 | Takahashi et al. | 198/468.4 |
| 5,121,623 | 6/1992 | Brzezniak | 72/405 |
| 5,140,839 | 8/1992 | Bruns | 72/405 |
| 5,148,697 | 9/1992 | Shiraishi et al. | 72/405 |
| 5,159,827 | 11/1992 | Shiraishi et al. | 72/405 |
| 5,248,288 | 9/1993 | Kamiya | 483/28 |
| 5,257,899 | 11/1993 | Asakura et al. | 414/752 |
| 5,269,168 | 12/1993 | Ogawa | 72/405 |
| 5,350,166 | 9/1994 | Shimizu et al. | 271/14 |
| 5,352,086 | 10/1994 | Mank | 414/797 |
| 5,359,875 | 11/1994 | Sova | 72/336 |
| 5,363,683 | 11/1994 | Thudium et al. | 72/405 |
| 5,363,684 | 11/1994 | Thudium et al. | 72/495 |
| 5,363,685 | 11/1994 | Luthi et al. | 72/405 |
| 5,368,286 | 11/1994 | Horsman et al. | 271/11 |
| 5,372,066 | 12/1994 | Proctor | 101/118 |
| 5,383,348 | 1/1995 | Michael et al. | 72/405 |
| 5,385,040 | 1/1995 | Michael et al. | 72/405 |
| 5,388,952 | 2/1995 | Hofele et al. | 414/752 |
| 5,445,370 | 8/1995 | Soga | 271/12 |

FOREIGN PATENT DOCUMENTS

| | | |
|---|---|---|
| 95355 | 11/1985 | Japan . |
| 161825 | 2/1987 | Japan . |
| 2142431 | 8/1987 | Japan . |
| 238032 | 10/1987 | Japan . |
| 273530 | 11/1988 | Japan . |
| 299729 | 12/1990 | Japan . |
| 38526 | 1/1991 | Japan . |
| 300036 | 10/1992 | Japan . |
| 2244227 | 11/1919 | United Kingdom . |
| 2264254 | 5/1993 | United Kingdom . |

FIG. 15
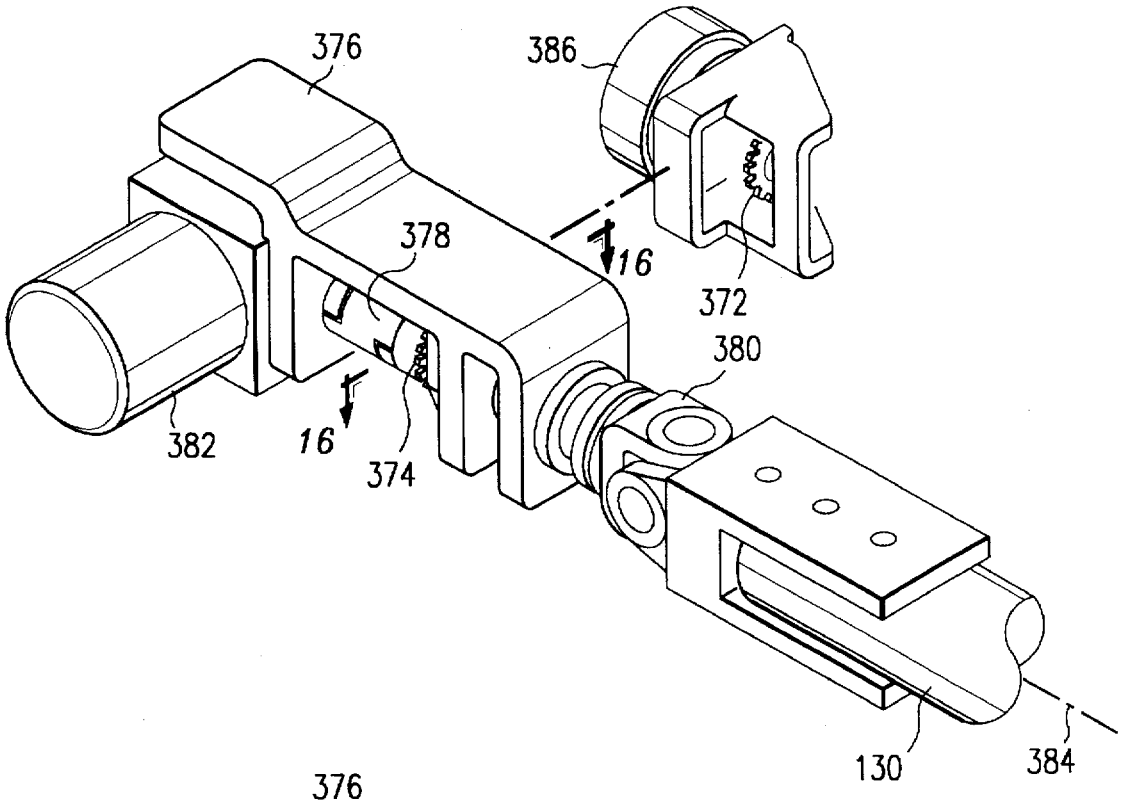
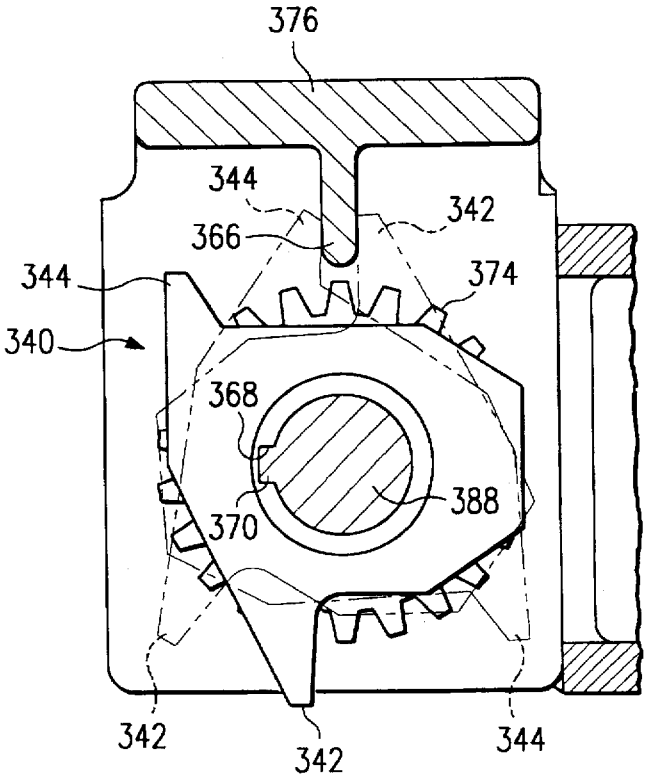
FIG. 16

SYSTEM AND METHOD FOR ROTATION OF CROSS BARS IN A MULTIPLE STATION TRANSFER PRESS

RELATED PATENT APPLICATION

This patent application is a continuation-in-part of patent application Ser. No. 08/393,554 filed Feb. 23, 1995, now U.S. Pat. No. 5,632,181, entitled "System and Method for Transferring a Work Piece in a Multi-Station Press."

TECHNICAL FIELD OF THE INVENTION

This invention relates in general to the field of multiple station transfer presses. More particularly, the present invention relates to a system and method for selective rotation of individual cross bars in a multiple station transfer press.

BACKGROUND OF THE INVENTION

Sheet metal is used to form the basic components of many commercial products. For example, sheet metal is used to form parts for automobiles, appliances, airplanes and other mass produced items. To transform sheet metal into an appropriately sized and shaped part, a sheet metal work piece must be pressed, bent, cut, pierced, trimmed, etc.

A transfer press is typically used to expedite the process of forming parts from sheet metal. Transfer presses often include several upper and lower die sets or combinations that are arranged in a line within the transfer press. The die sets or die combinations are referred to as press stations. The dies for each press station are chosen to perform specific functions to create a desired part from a work piece. The transfer press generally includes an automated system to transfer the work piece from one press station to the next to increase the rate of output by the transfer press.

Over the years, the size of parts formed from sheet metal has increased significantly. For example, individual parts for automobiles such as doors and body panels have increased in size. Large parts typically slow down a conventional transfer press thus decreasing its output capability. Generally, it takes longer to move a large part between adjacent press stations. Additionally, large parts make it more difficult to reorient each work piece between dies because larger parts are more difficult to handle.

Prior systems and methods for transferring a work piece in a multiple station transfer press have used independent vertical and horizontal movement of a cross bar assembly. This independent vertical and horizontal movement frequently limited the rate at which large work pieces could be processed. Other systems use simultaneous vertical and horizontal movement of a cross bar assembly to increase the output of the associated transfer press. This type of movement is shown by way of example in U.S. Pat. No. 5,148,697 issued to Shiraishi, et al. entitled "Method for Withdrawing Work Piece From Drawing Mold" and U.S. Pat. No. 4,981,031 issued to Schneider, et al. entitled "Transfer Device in a Transfer Press or Similar Metal-Forming Machine." Shiraishi and Schneider both disclose movement of a cross bar along a curved path from a rest position between stations to a first press station. The work piece is transferred from the first press station to a second press station over a curved path and the cross bar returns to the rest position between press stations. The cross bar stays in the rest position during each pressing operation.

The Schneider patent also shows cross bar assemblies with carriages formed with low-mass construction to allow increased acceleration and thus a higher operating speed for the associated transfer press. Schneider also discloses idle stations disposed between each of the press stations to help reorient the work piece for subsequent processing. Although the idle stations may allow shortening the transfer movements of the work piece, they also introduce a delay by adding extra stations. Also, the idle stations require additional tooling. The idle stations add to the possibility of damaging a work piece by doubling the number of times each work piece is handled.

While changing the dies at a press station to fabricate a different part, it is often necessary to replace either the complete cross bar assembly or the holding devices on the associated cross bars to accommodate work pieces with configurations corresponding with the new die sets. Also, one or more holding devices may need to be replaced as part of normal maintenance and repair of the associated transfer press. Typically, changing holding devices in prior transfer presses required either removing the complete cross bar assembly or at least the respective cross bar from the associated transfer press. Therefore, replacing the complete cross bar assembly and/or holding devices often resulted in substantial downtime for the associated transfer press.

SUMMARY OF THE INVENTION

In accordance with teachings of the present invention, a system and method for transferring a work piece in a multiple station transfer press are provided to substantially eliminate or reduce disadvantages and problems associated with previous multiple station transfer presses. One aspect of the present invention includes a multiple station transfer press having at least one cross bar assembly which allows selective rotation of each associated cross bar relative to the cross bar assembly. Technical advantages resulting from being able to independently rotate each cross bar include the ability to easily change holding devices coupled to or mounted on each cross bar, to orient the angle of the holding devices relative to the longitudinal axis of their respective cross bar to accommodate various die and work piece configurations and/or to facilitate changing die sets at the associated press stations without having to replace the respective cross bar assemblies.

One embodiment of the present invention includes a system for both moving and orienting a work piece in a multiple station transfer press having a plurality of press stations with associated upper and lower dies. The system includes at least one cross bar assembly that extends above the press stations transverse to the general direction for moving work pieces between adjacent press stations. This direction is sometimes referred to as the direction of flow. Each cross bar assembly includes at least one cross bar with a plurality of holding devices coupled to or mounted on each cross bar for releasably engaging a work piece for movement between adjacent press stations and orienting the work piece as appropriate for the receiving press station.

A cross bar assembly incorporating teachings of the present invention generally moves in a cyclical manner between associated first and second press stations. The cross bar assembly preferably begins in a first rest position adjacent to the second press station. The cross bar assembly first moves into the first press station wherein the associated holding devices engage a work piece and moves the work piece to the second press station. The cross bar assembly next moves from the second press station to a second rest position. The second rest position is preferably located adjacent to the first press station. Finally, the cross bar assembly returns to the first rest position. A predetermined portion of the movement between the rest positions may occur while the upper die is separated from the lower die by less than a maximum separation at the respective press stations. Also, each cross bar may be selectively rotated relative to its longitudinal axis and associated cross bar assembly to provide angular orientation or polar rotation of the associated holding devices as required for a specific work piece and/or die set configuration.

Further technical advantages of the present invention include providing a cross bar assembly which moves toward a first press station before the upper and lower dies are completely separated and moves away from a second press station while the upper die begins to move toward the lower die, thus increasing the speed and efficiency with which the cross bar assembly is able to transfer large work pieces between adjacent press stations. Also, each cross bar assembly may include at least one cross bar which can be rotated 180° relative to the longitudinal axis of the respective cross bar and the associated cross bar assembly to accommodate replacing holding devices mounted on the respective cross bar while at the same time replacing the die sets at adjacent press stations.

According to another aspect of the present invention, each cross bar assembly may be programmed to provide dynamic orientation of a work piece during transfer between adjacent press stations. In one embodiment, each cross bar assembly includes a pair of opposite carriages with two cross bars extending between each pair of carriages. The carriages are mounted on a pair of transfer rails that extend along the length of the transfer press. One of the carriages further includes a motor and an encoder attached to one end of each cross bar such that the cross bars may be independently rotated relative to each other and relative to the associated cross bar assembly. Holding devices such as vacuum cups are preferably slidably coupled to or mounted on each cross bar. Each vacuum cup or each set of vacuum cups may be programmed to move independently along the length of the respective cross bar while the cross bar is independently rotated relative to the associated cross bar assembly. Each cross bar assembly can be programmed to tilt a work piece relative to the direction of flow through the transfer press or in a direction perpendicular to the direction of flow depending upon the configuration of the associated die sets. Additionally, each cross bar assembly can be programmed to raise and lower a work piece with respect to the associated die sets.

Additional technical advantages of the present invention include allowing a cross bar assembly with two or more cross bars to store the respective cross bars close together at the associated rest position and separating the cross bars from each other when moving into a press station to engage and lift a work piece. For one application, the cross bars may also be independently rotated approximately thirty degrees (30°) in a clockwise direction or thirty degrees (30°) in a counterclockwise direction to accommodate the desired configuration and orientation of a work piece in a specific die set. This increases the speed and efficiency of the resulting transfer press by decreasing space requirements for the rest positions, decreasing the overall distance traveled by a work piece in the transfer press, and increasing flexibility in designing die sets.

For one application, a servo motor and at least one encoder are provided to rotate each respective cross bar and to provide a signal indicating the angular orientation or polar rotation of the respective cross bar and its associated holding devices relative to the longitudinal axis of the cross bar. The encoder preferably provides the control system for the associated transfer press with information concerning the position of the respective cross bar and its associated holding devices at all times during operation of the transfer press. Each cross bar and associated components used to rotate the cross bar are preferably stiff in the direction of rotation to ensure that reliable position information is available to the control system for the transfer press and to ensure the desired orientation of a work piece attached to the associated holding devices. The mechanical components associated with each cross bar are preferably press fit or clamped to each other to substantially reduce or eliminate any undesired angular movement between the various components. A mechanical stop is also preferably included as a component of each cross bar to limit rotation between 30° in a clockwise direction and 180° in a counterclockwise direction. By limiting polar rotation of the associated cross bar, the mechanical stop prevents twisting of electrical cables and/or vacuum hoses which may be strapped to or carried within the cross bar.

As a result of the present invention, the same cross bar assembly can be used to transfer a wide variety of work pieces without requiring changing out the cross bar assembly. Also, each cross bar may be rotated 180° relative to its longitudinal axis to accommodate easy replacement of the respective holding devices, thus, eliminating the need to replace the complete cross bar assembly during die changes. Rotating each cross bar 180° substantially reduces the amount of time required to replace the associated holding devices and/or die sets. Thus, maintenance time and die change time may be reduced while increasing the overall quantity of parts produced by the associated transfer press.

The present invention provides a system and method for increasing the speed of transferring a work piece in a multiple station transfer press used to fabricate relatively large parts, reduces the possibility of damage to a work piece, allows for reorientation of each work piece between adjacent press stations without significantly reducing the overall speed of the transfer press, and accommodates work pieces and dies requiring specific angular orientation of the holding devices relative to the associated die sets and the general direction of work piece flow.

BRIEF DESCRIPTION OF THE DRAWINGS

For a more complete understanding of the present invention and the advantages thereof, reference is now made to the following written description taken in conjunction with the accompanying drawings in which:

FIG. 15 is a schematic drawing showing an exploded, perspective view with portions broken away of a motor, gear box, encoder and associated components coupled to a cross bar to allow polar rotation of the cross bar and associated holding devices; and FIG. 16 is a schematic drawing in section with portions broken away taken along lines 16—16 of FIG. 15 showing a mechanical stop which limits polar rotation of the associated cross bar.

DETAILED DESCRIPTION OF THE INVENTION

The preferred embodiments of the present invention and its advantages are best understood by referring to FIGS. 1–16 of the drawings, like numerals being used for like and corresponding parts of the various drawings.

Figure 1:
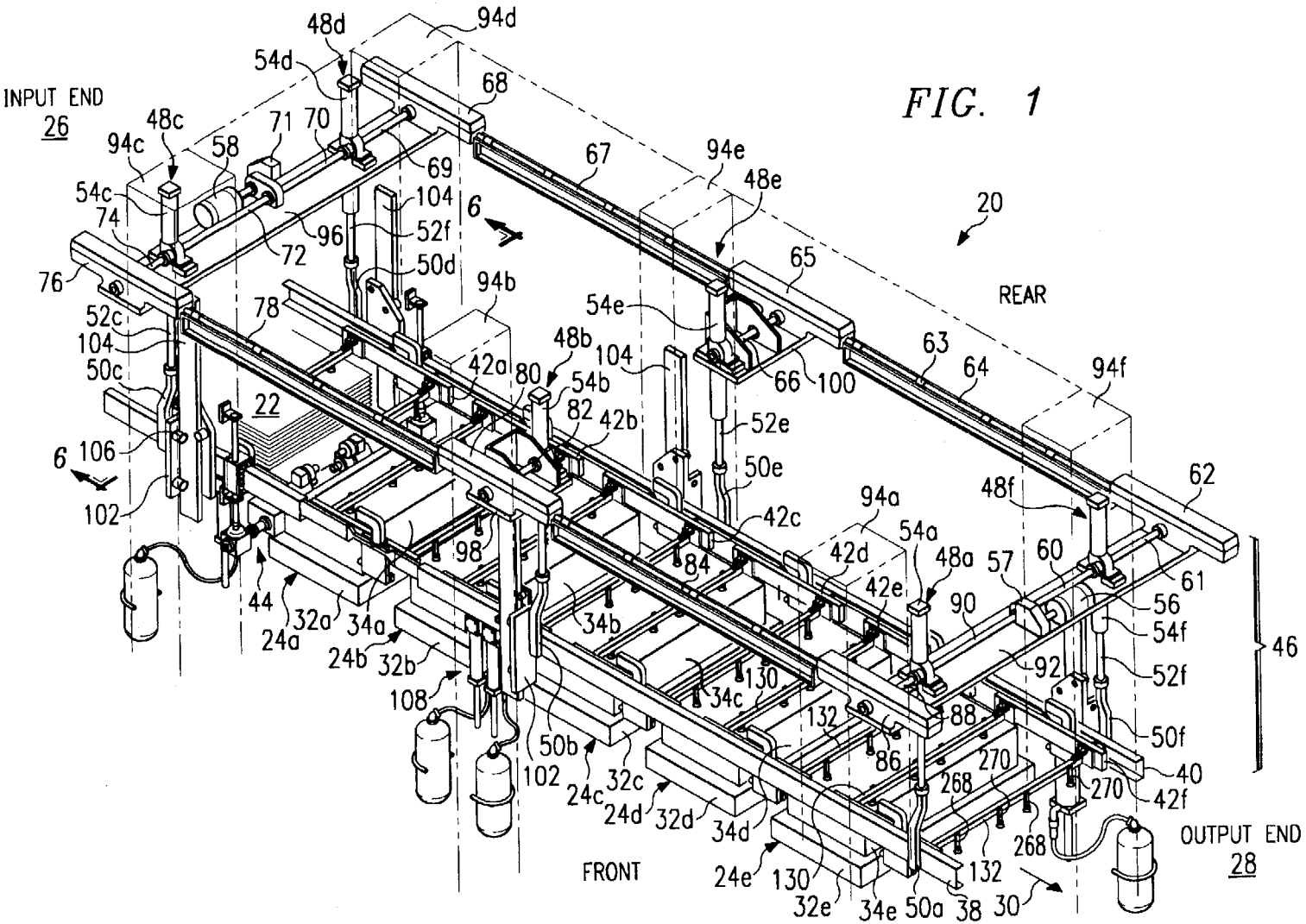
FIG. 1 is a schematic drawing showing a perspective view with portions broken away of a multiple station transfer press and a system for transferring a work piece from one press station to the next constructed according to teachings of the present invention.
Figure 2:
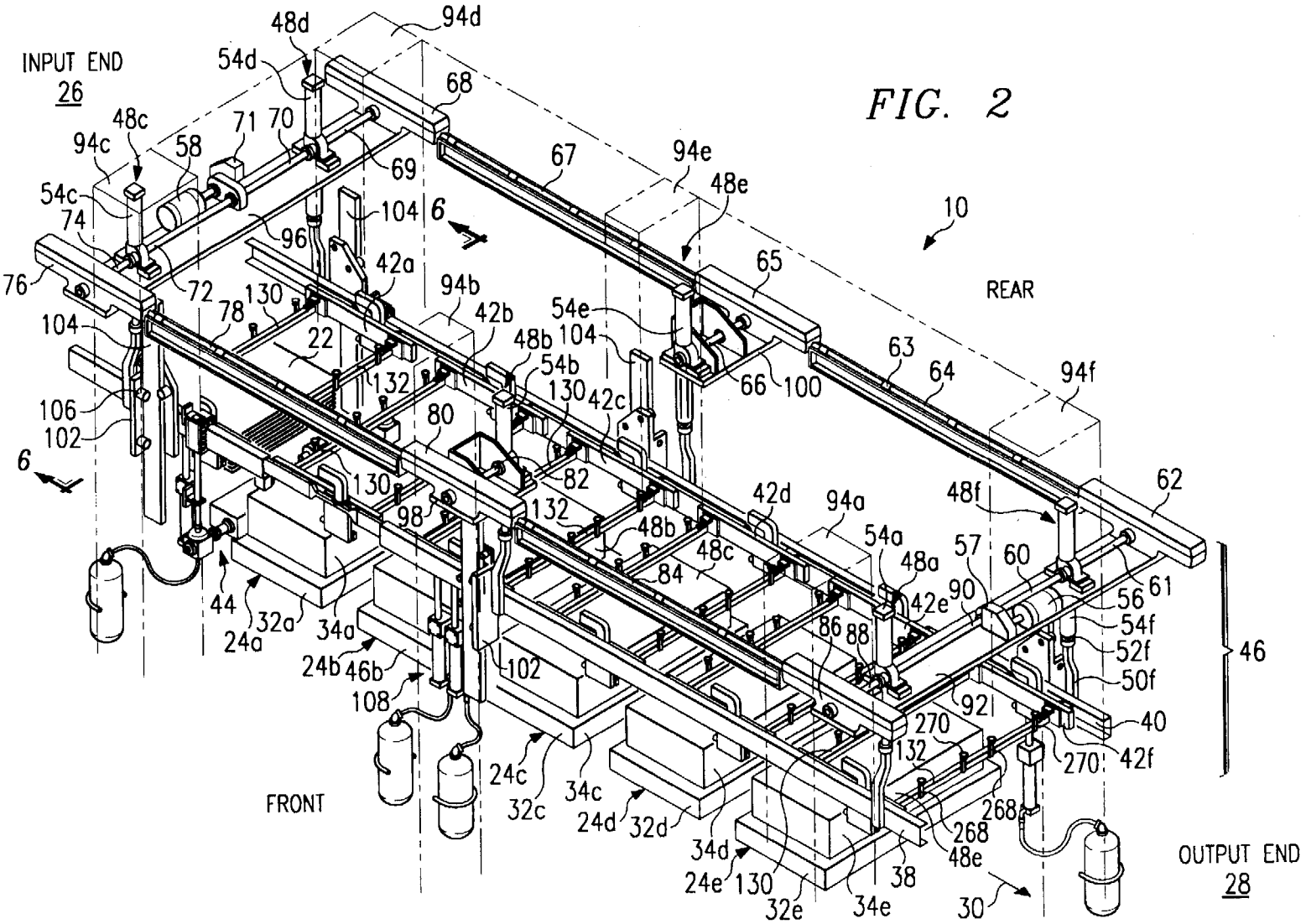
FIG. 2 is a schematic drawing showing a perspective view with portions broken away of the multiple station transfer press of FIG. 1 with the associated cross bar assemblies in a raised position to accommodate changing die sets at each press station along with each cross bar rotated 180° to allow changing the respective holding devices.

FIGS. 1 and 2 show a multiple station transfer press, indicated generally at 20 and constructed according to teachings of the present invention. For the embodiment shown in FIGS. 1 and 2, a stack of sheet metal pieces or work pieces 22 are located at the input end or entry side 26 of transfer press 20. As will be discussed later in more detail, each work piece 22 preferably moves sequentially through each press station 24*a* through 24*e* towards output end or exit side 28. Arrow 30 at output end 28 shows the general direction of flow as each work piece 22 moves through transfer press 20.

An important feature of the present invention includes the ability to vary the orientation of each work piece 22 relative to respective die sets at each press station 24*a* through 24*e* along the general direction of flow 30. Examples of varying the orientation of work pieces 22 will be discussed later in more detail.

The present invention may be used with a transfer press having any number of press stations and is not limited to use with transfer press 20 having only five press stations 24*a* through 24*e*. Also, for some applications, input end or entry side 26 and output end or exit side 28 may be reversed depending upon the configuration of the associated die sets and the location of transfer press 20 relative to other manufacturing equipment (not shown) and/or related manufacturing procedures. For purposes of explanation, one side of transfer press 20 as shown in FIGS. 1 and 2 has been labeled FRONT and the opposite side labeled REAR. Again, depending upon the specific application, the "front" and "rear" sides of transfer press 20 may be reversed.

FIGS. 8A through 8F show upper die 36*a* and lower die 34*a* associated with press station 24*a* along with upper die 36*b* and lower die 34*b* associated with press station 24*b*. For purposes of this patent application a die set includes an upper die 36 and a lower die 34 along with other components which are normally associated with transfer presses. Each press station 24*a* through 24*e* preferably includes a respective bolster 32*a* through 32*e*, lower die 34*a* through 34*e*, and an upper die 36*a* through 36*e*. Upper dies 36*a* through 36*e* are not shown in FIGS. 1 or 2. Transfer press 20 moves each work piece 22 through press stations 24*a* through 24*e* to create a part with a desired configuration at output end 28.

As will be discussed later in more detail, the present invention allows independent rotation of each cross bar 130 and 132 of the respective cross bar assemblies 42*a* through 42*e* to allow replacement of the associated die sets and associated holding devices 268 and 270 coupled to or mounted on each cross bar 130 and 132 without requiring a complete replacement of the associated cross bar assembly 42. The ability to independently rotate each cross bar 130 and 132 allows using die sets with a wide variety of configurations for forming the desired part from work piece 22. Transfer press 20 preferably includes a conventional slide (not shown) for raising and lowering upper dies 36*a* through 36*e* such as shown and described in U.S. Pat. No. 5,097,695.

Transfer press 20 provides a system for transferring work pieces 22 between press stations 24*a* through 24*e*. The transfer system includes a pair of transfer rails 38 and 40 mounted opposite from each other and extending along the FRONT and REAR of transfer press 20 in the direction of flow 30. Transfer rails 38 and 40 preferably do not extend beyond the perimeter of transfer press 20 during operation to reduce the risk of inadvertent injury.

The transfer system provides simultaneous vertical and longitudinal movement of each work piece 22 between adjacent press stations 24*a* through 24*e* along a non-linear path such as shown and described with respect to FIGS. 8A through 8G. The transfer system also allows for lateral and rotational orientation of each work piece 22 relative to the associated die sets at press stations 24*a* through 24*e* along the general direction of flow 30. The present invention provides transfer press 20 with eight degrees of freedom for movement of cross bars 130 and 132 to properly orient each work piece 22 at each press station 24*a* through 24*e* and to improve the overall operating efficiency of transfer press 20.

The principal horizontal component for movement of each work piece 22 is provided by a plurality of cross bar assemblies 42*a* through 42*f* and a feed drive mechanism indicated generally at 44. This aspect of the transfer system is described in more detail with respect to FIGS. 6 and 7. The principal vertical component for movement of each work piece 22 is provided by a plurality of lift mechanisms indicated generally at 46. As discussed later in more detail, each cross bar assembly 42 can also provide a horizontal and vertical component for movement of work piece 22 between adjacent press stations.

Lift mechanisms 46 of transfer press 20 provide vertical movement to work pieces 22 by raising and lowering transfer rails 38 and 40. Each lift mechanism 46 includes a plurality of vertical lift assemblies indicated generally at 48*a* through 48*f* disposed along the length of transfer rails 38 and 40. As shown in FIGS. 1 and 2, lift mechanisms 46 comprises three vertical lift assemblies 48*a*, 48*b*, and 48*c* disposed along the length of transfer rail 38 and three vertical lift assemblies 48*d*, 48*e* and 48*f* disposed along the length of transfer rail 40. It is understood that the number of vertical lift assemblies 48 may be varied in accordance with teachings of the present invention along with the number of press stations 24 and the length of transfer press 20.

Each vertical lift assembly 48 comprises a support member 50 that is coupled to either transfer rail 38 or 40. For example, support members 50*a*, 50*b* and 50*c* are coupled to transfer rail 38. Additionally, support members 50*d* through 50*f* are coupled to transfer rail 40. Lift rods 52*a* through 52*f* couple corresponding support members 50*a* through 50*f* to vertical rack and pinion assemblies 54*a* through 54*f*. Each vertical rack and pinion assembly 54*a* through 54*f* may comprise a part number ST 1400-VP-50 commercially available from Flo-Tork in Orrville, Ohio or any other appropriate part for translating rotational motion into linear motion.

Vertical lift assemblies 48*a*, through 48f raise and lower transfer rails 38 and 40 through a drive mechanism including drive motors 56 and 58. Drive motor 56 is coupled to a right angle gear box 57. Torque tube 60 is coupled between right angle gear box 57 and the pinion of vertical rack and pinion assembly 54*f*. Torque tube 61 is also coupled between the pinion of vertical rack and pinion assembly 54 and a pinion of first horizontal rack and pinion assembly 62. A drive rod 64 is coupled between the rack of first horizontal rack and pinion assembly 62 and a rack of a second horizontal rack and pinion assembly 65. Drive rod 64 is guided by ball bushings 63 spaced out along the length of drive rod 64.

Torque tube 66 is coupled between the pinion of second horizontal rack and pinion assembly 56 and vertical rack and pinion assembly 54*e*. Additionally, drive rod 67 is coupled between the rack of second horizontal rack and pinion assembly 65 and a third horizontal rack and pinion assembly 68. Torque tube 69 is coupled between the pinion of third horizontal rack and pinion assembly 68 and a pinion of vertical rack and pinion assembly 54*d*. Torque tube 70 is coupled between the pinion of vertical rack and pinion assembly 54*d* and right angle gear box 71.

Drive motor 58 is also coupled to right angle gear box 71. Torque tube 72 is coupled between right angle gear box 70 and a pinion of vertical rack and pinion assembly 54*c*. Torque tube 74 is coupled between the pinion of vertical rack and pinion assembly 54*c* and the pinion of fourth horizontal rack and pinion assembly 76. Drive rod 78 is coupled between the rack of fourth horizontal rack and pinion assembly 76 and the rack of fifth horizontal rack and pinion assembly 80. Torque tube 82 is coupled between the pinion of fifth horizontal rack and pinion assembly 80 and the pinion of vertical rack and pinion assembly 54*b*. Drive rod 84 is coupled between the rack of fifth horizontal rack and pinion assembly 80 and a sixth horizontal rack and pinion assembly 86. Torque tube 88 is coupled between the pinion of sixth horizontal rack and pinion assembly 86 and the pinion of vertical rack and pinion assembly 50*a*. Finally, torque tube 90 is coupled between vertical rack and pinion assembly 54*a* and right angle gear box 57. Lift mechanisms 46 operates by translating rotationally motion provided by drive motors 56 and 58 into linear motion of support members 50*a* through 50*f* to raise and lower transfer rails 38 and 40.

A portion of each lift mechanism 46 of transfer press 20 is suspended above respective transfer rails 38 and 40. Support platform 92 is coupled between vertical columns 94*a* and 94*f*. Drive motor 56, vertical rack and pinion assemblies 54*a* and 54*f*, and first and sixth horizontal rack and pinion assemblies 62 and 86 are disposed on support platform 92. Similarly, drive motor 58, vertical rack and pinion assemblies 54*c* and 54*d*, and third and fourth horizontal rack and pinion assemblies 68 and 76 are disposed on support platform 96 between vertical columns 94*c* and 94*d* of transfer press 20. Support platform 98 is coupled to vertical column 94*b* of transfer press 20 to support fifth horizontal rack and pinion assembly 80 and vertical rack and pinion assembly 54*b*. Finally, support platform 100 is coupled to a vertical column 94*e* to support second horizontal rack and pinion assembly 65 and vertical rack and pinion assembly 54*e*. Vertical columns 94*a* through 94*f* are shown in dotted lines in FIGS. 1 and 2.

Figure 6:
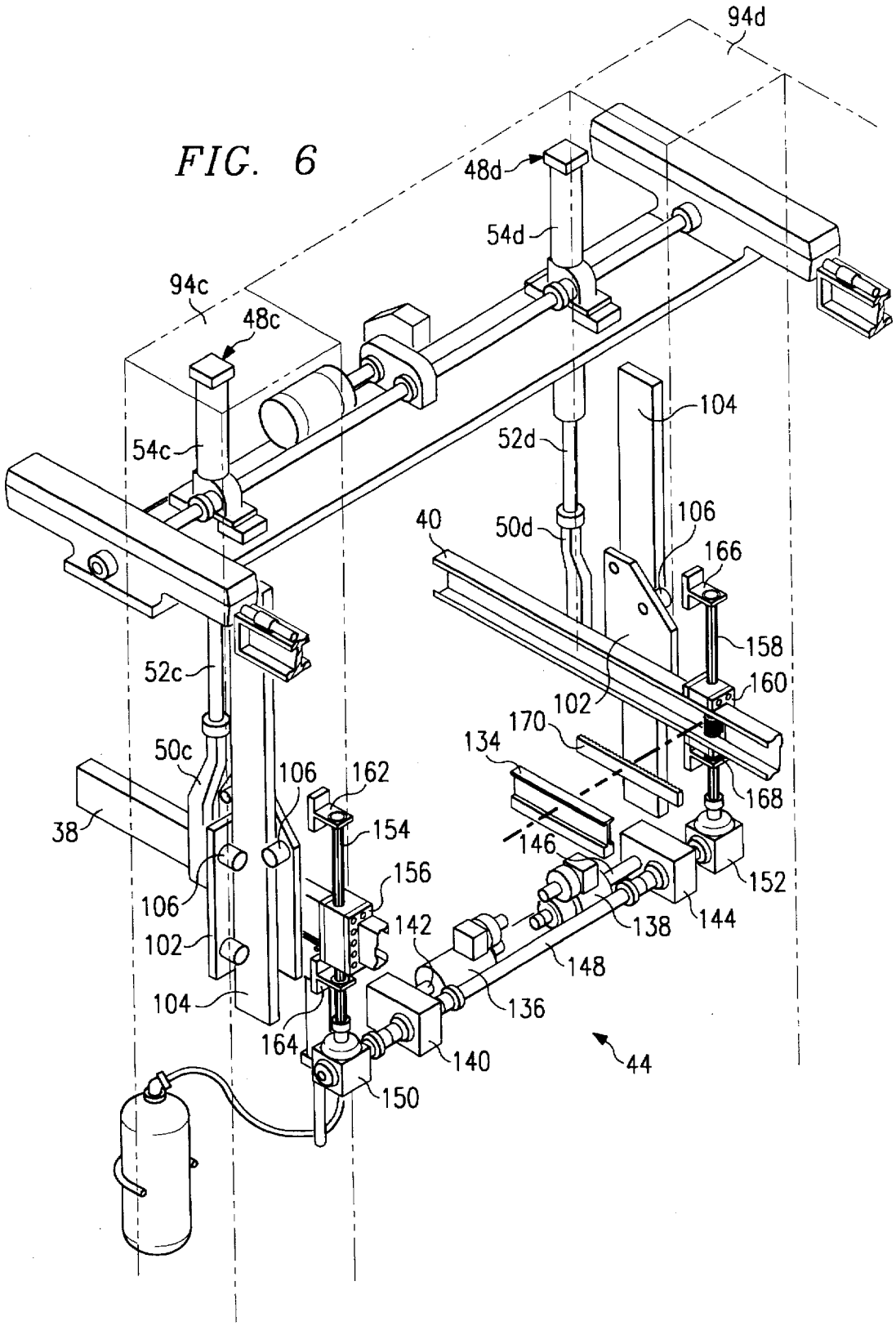
FIG. 6 is a perspective view taken along lines 6—6 of FIG. 1 with portions broken away.

The vertical motion of transfer rails 38 and 40 is directed by guide members 102. Guide members 102 are slidably mounted on linear member 104 by a plurality of guide pins 106. As shown in FIGS. 1, 2 and 6, guide members 102 each comprise a right angle body having guide pins 106 extending perpendicular to adjacent surfaces of guide member 102 so as to slidably engage linear member 104. Each linear member 104 is coupled to a respective vertical column 94*a* through 94*f* of transfer press 20. Only some of the linear members 104 are shown in FIGS. 1 and 2. However, it is noted that at least one linear member 104 may be coupled to each vertical column 94*a* through 94*f* to maintain each transfer rail 38 and 40 in a respective vertical plane as transfer rails 38 and 40 are raised and lowered.

In operation, vertical lift assemblies 48*a*, through 48*f* raise and lower transfer rails 38 and 40. In raising transfer rails 38 and 40, lift drive motor 56 provides a first predetermined rotational motion to torque tube 60. Torque tube 48 turns the pinion of vertical rack and pinion assembly 54*f*. The pinion engages the rack in vertical rack and pinion assembly 54*f* and thus raises lift rod 52*f*, support member 50*f* and rail 40.

Motor 56 also rotates torque tube 61. Torque tube 61 rotates the pinion of first horizontal rack and pinion assembly 62. The pinion engages the rack of first horizontal rack and pinion assembly 62. Drive rod 64 thus extends toward second horizontal rack and pinion assembly 65. Torque tube 66 rotates with the pinion of second horizontal rack and pinion assembly 65. Thus, vertical rack and pinion assembly 54*e* raises lift rod 52*e*, support member 50*e* and transfer rail 40. Motors 56 and 58 similarly control vertical lift assemblies 48*a*, through 48*d*.

FIG. 2 is similar to FIG. 1 except transfer rails 38 and 40 are shown in their fully raised position to allow changing die sets (upper dies 36*a* through 38*e* and lower dies 34*a*–34*e*) at each press station 24*a* through 24*e*. Upper dies 36 are not expressly shown in FIG. 2 for purposes of illustration. Also, each cross bar 130 and 132 has been rotated 180° from its normal operating position to allow changing the associated holding devices 268 and 270 mounted on or coupled to each cross bar 130 and 132. Thus, the present invention allows using a wide variety of die sets (lower die 34 and upper die 36) without requiring a complete change of the cross bar assembly 42 located at each press station 24. The present invention allows the same cross bar assembly 42, along with appropriate holding devices, to be used with a wide variety of work pieces and die sets having various configurations.

Figure 3A:
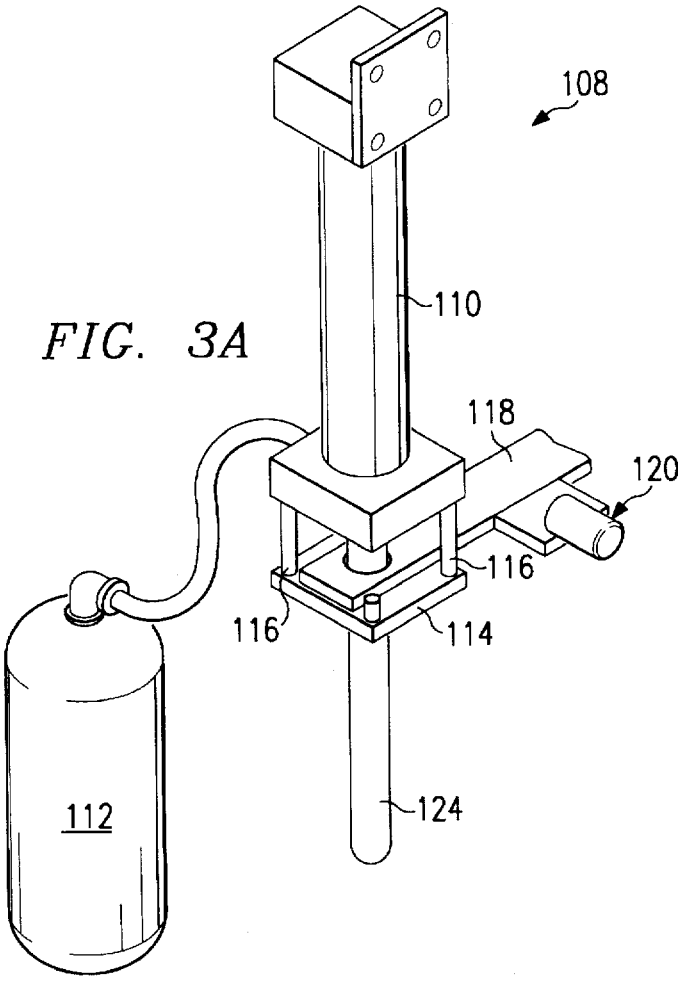
FIGS. 3A and 3B are perspective views of a safety mechanism constructed according to teachings of the present invention for a counter balance system for the multiple station transfer press of FIG. 1.
Figure 3B:
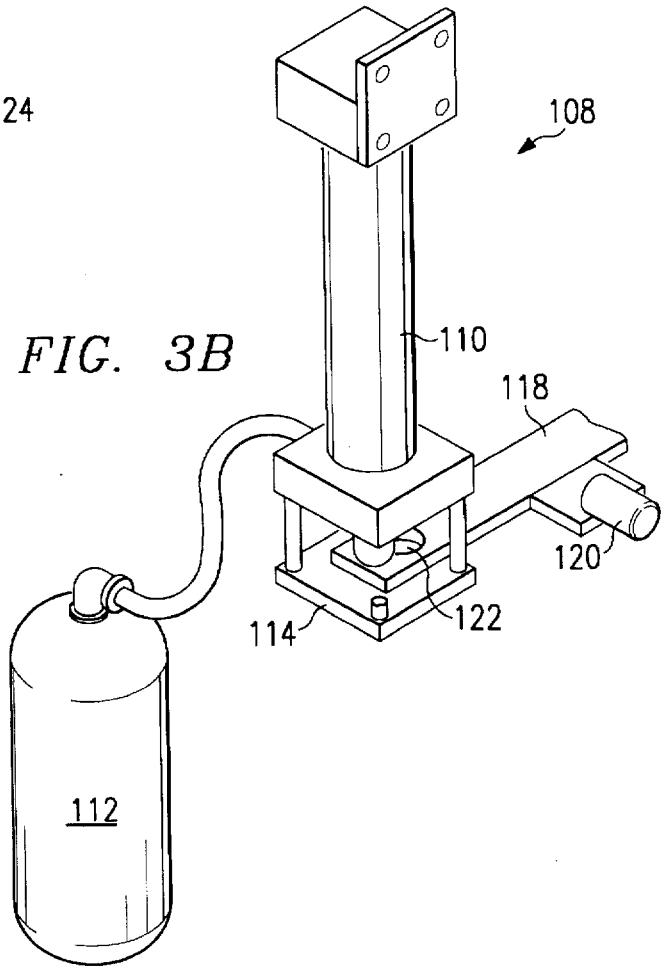

Transfer press 20 further includes a plurality of counterbalance assemblies 108 disposed along the length of transfer rails 38 and 40 to reduce the amount of force necessary to lift transfer rails 38 and 40. FIG. 3A and 3B illustrate one embodiment of a counterbalance assembly indicated generally at 108. Counterbalance assembly 108 comprises a counterbalance cylinder 110 and a reservoir 112 coupled to cylinder 110 to maintain the proper pressure within cylinder 110. In operation, the pressure in cylinder 110 causes an upward force to counterbalance the weight of an associated transfer rail 38 or 40.

Counterbalance assembly 108 further includes a support plate 114 separated from cylinder 112 by spacers 116. An anti-drift plate 118 is slidably disposed on support plate 114. Motion of anti-drift plate 118 is controlled by linear actuator motor 120. A cylindrical opening 122 is provided in anti-drift plate 118 to receive lift lock rod 124.

In operation, counterbalance assembly 108 prevents transfer rails 38 and 40 from inadvertently lowering when the die sets at press stations 24*a* through 24*e* are being changed. During normal operation, lift lock rod 124 extends through cylindrical opening 122 as shown in FIG. 3A. When a lower die 34 is changed, transfer rails 38 and 40 are raised as shown in FIG. 2. Lift lock rod 124 moves up through cylindrical opening 122. Once lift lock rod 124 is clear of the top of anti-draft plate 118, linear actuator motor 120 moves anti-drift plate 118 to its second position shown in FIG. 3B such that lift lock rod 124 does not line up with cylindrical opening 122. Thus, transfer rails 38 and 40 are locked in their raised position while lower dies 34*a* through 34*e* are changed.

Figure 4:
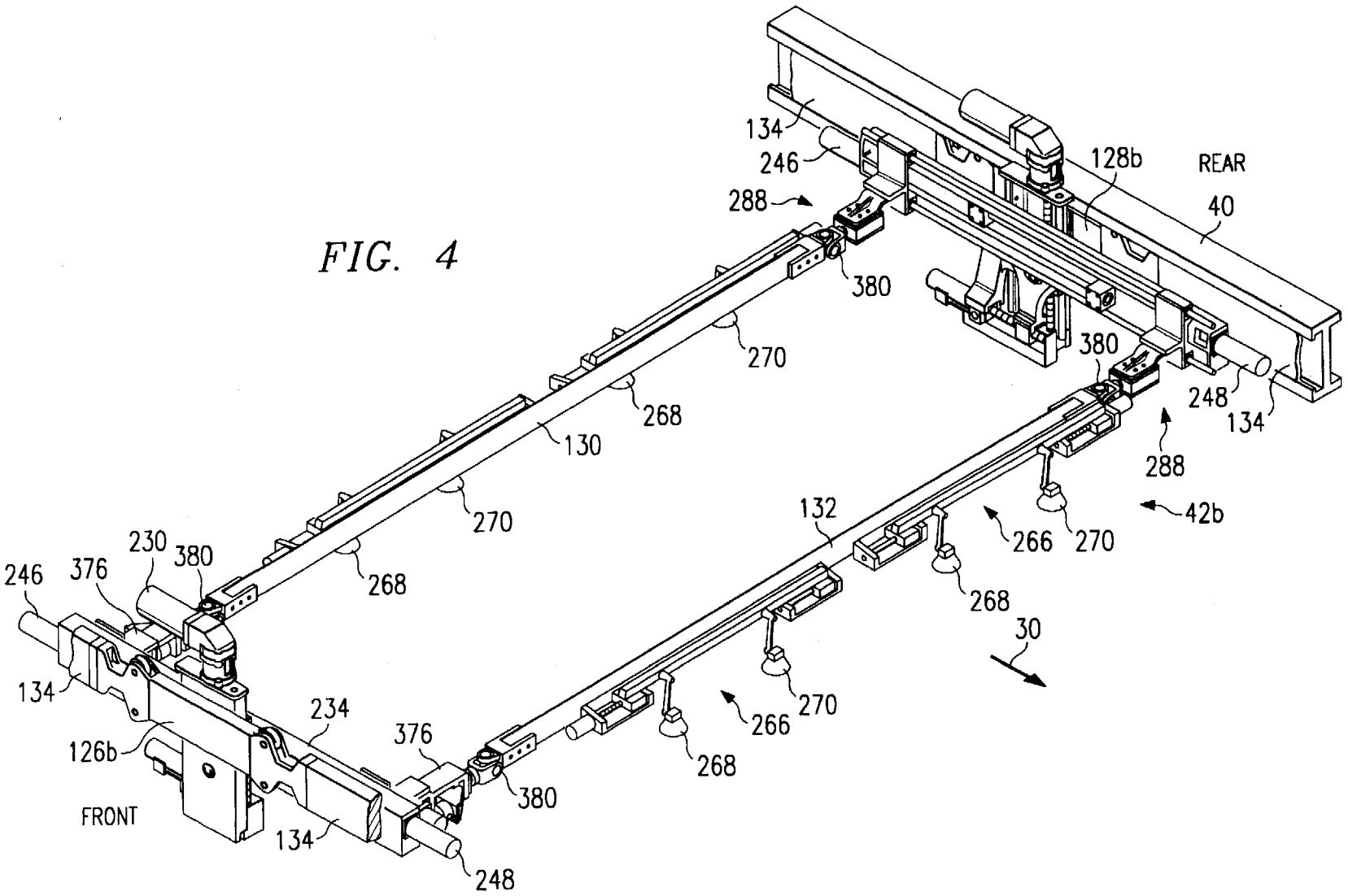
FIG. 4 is a schematic drawing showing a perspective view of a cross bar assembly constructed according to teachings of the present invention for use in the multiple station transfer press of FIG. 1.
Figure 5:
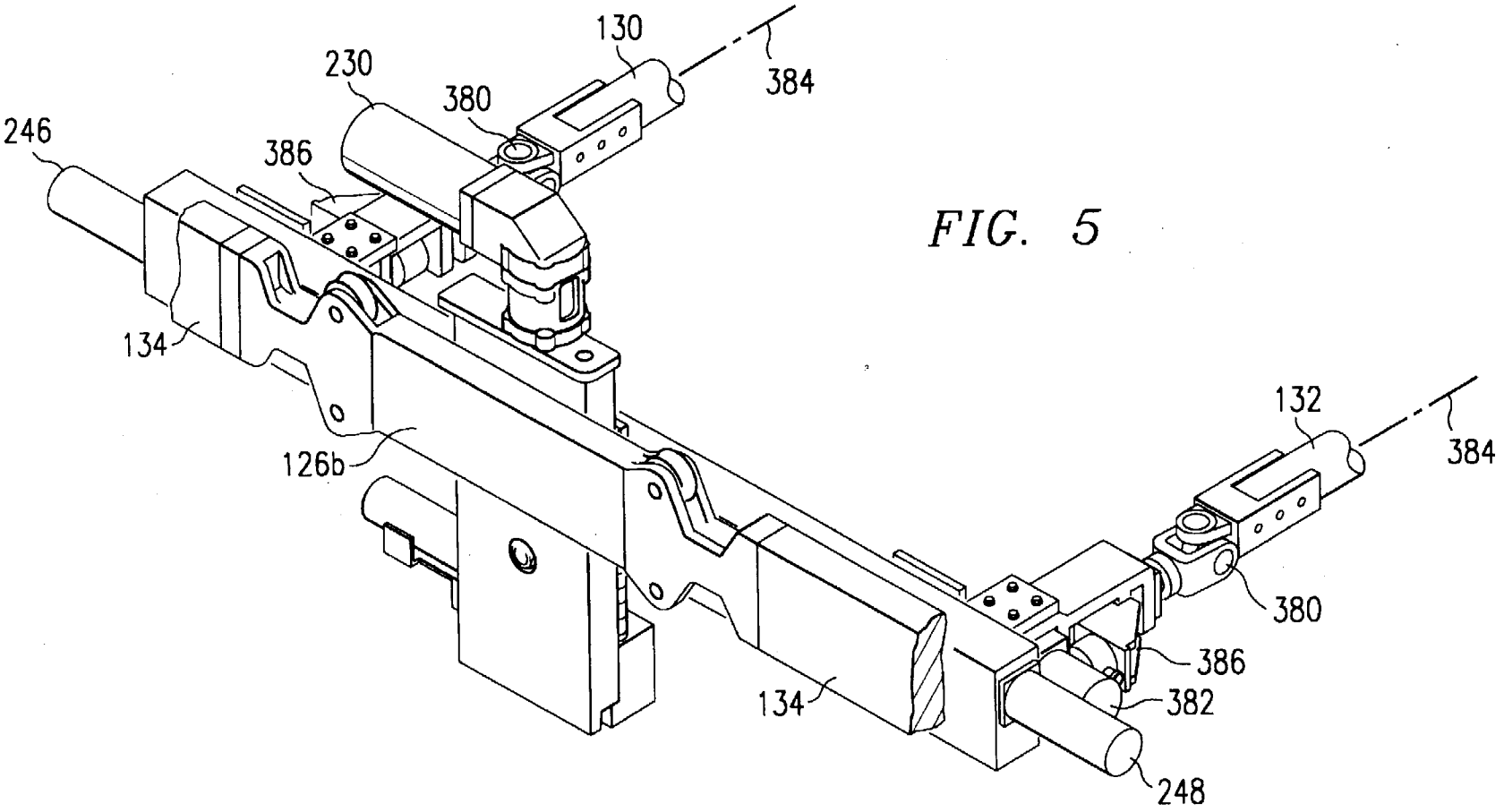
FIG. 5 is a schematic drawing showing an enlarged perspective view with portions broken away of the cross bar assembly of FIG. 4 having, among other components, a motor, a gear box, an encoder and a universal joint to individually rotate each cross bar.

The principal horizontal component for movement of work pieces 22 is provided by cross bar assemblies 42*a* through 42*f* that reciprocate along transfer rails 38 and 40. FIGS. 4 and 5 show one embodiment of a cross bar assembly incorporating various teachings of the present invention indicated generally at 42*b* with transfer rail 38 removed for clarity. Although only cross bar assembly 42*b* is shown, the description of FIGS. 4 and 5 is applicable to each cross bar assembly 42*a* through 42*f*.

Cross bar assembly 42*b* extends between transfer rails 38 and 40 in a direction generally perpendicular to the direction of flow 30 for work pieces 22. An important benefit of the present invention includes the ability to substantially vary the orientation of each cross bar assembly 42 and its associated cross bars 130 and 132 relative to the direction of flow 30. Cross bar assembly 42*b* comprises a first carriage 126*b* slidably mounted on transfer rail 38 and an associated second carriage 128*b* slidably mounted on transfer rail 40. First and second cross bars 130 and 132 are respectively coupled between carriages 126*b* and 128*b*. Carriage 126*b* is separated from adjacent carriages (not expressly shown) for cross bar assemblies 42*a* and 42*c* by spacing members 134. Similarly, carriage 128*b* is also separated from adjacent carriages (not expressly shown) for cross bar assemblies 42*a* and 42*c* by spacing members 134. Cross bar assembly 42*b* reciprocates longitudinally back and forth along transfer rails 38 and 40 in the direction of flow 30 to move work piece 22 between press stations 24*a* and 24*b*.

For one application each cross bar 130 and 132 is approximately one hundred fifty-seven inches (157") long. A pair of universal joints 380 are preferably attached to opposite ends of each cross bar 130 and 132. One universal joint 380 is used to couple one end of each cross bar 130 and 132 to a respective electrical motor or servo motor 382 located adjacent to first carriage 126 at the front of transfer press 20. A second universal joint 380 is provided at the opposite end of each cross bar 130 and 132 for use in coupling each cross bar 130 and 132 with its respective bearing assembly 288 located adjacent to second carriage 128*b* at the rear of transfer press 20. Bearing assembly 288 is shown in more detail in FIG. 11.

Cross bars 130 and 132 may have a circular cross section such as shown in FIGS. 5 and 15 or a rectangular cross section such as shown in FIG. 11 and FIGS. 12*a* through 12*f*. Also, cross bars 130 and 132 may include a hollow interior and/or one or more recesses formed in the exterior of each cross bar 130 and 132 to accommodate electrical lines and/or vacuum hoses (not expressly shown).

An electrical motor such as servo motor 382 is provided at the end of each cross bar 130 and 132 adjacent to first carriage 126*b* to allow individual rotation of each cross bar 130 and 132. In FIGS. 4, 5, and 15, electrical motor 382 is positioned adjacent to horizontal member 234 with a ninety degree gear box 364 to allow rotation of the associated cross bar 130 and 132 relative to the longitudinal axis or center line 384 of each respective cross bar 130 and 132. For other applications, electrical motor 382 may be in alignment with longitudinal center line 384 of the associated cross bar 130. For purposes of the present application, rotating cross bars 130 and 132 relative to their respective center line or longitudinal axis 384 may sometimes be referred to as polar rotation.

Various types of electrical motors may be satisfactorily used to rotate cross bars 130 and 132. For one application electrical motor 382 is preferably a servo motor such as a Max Plus™ brushless servo motor which is available from Custom Servo Motors, Inc., a subsidiary of MTS Systems Corporations. Custom Servo Motors, Inc. is located at 214 N. Valley St., New Alm, Minn. 56073. The specific electrical motor selected to function as motor 382 will preferably produce high torque ratings from a relatively small exterior configurations.

An angle encoder 386 is preferably coupled with or attached to drive shaft 388 to provide information concerning the angular orientation of each of the associated cross bar 130 and 132 along with associated holding devices 268 and 270 relative to longitudinal axis 384. For one application, an absolute resolve or angle encoder offered by Stegman designated AG626 has been satisfactorily used.

Each cross bar 130 and 132 will preferably rotate one hundred and eighty degrees (180°) counterclockwise when looking from the front of transfer press 20 when going into the die change position as shown in FIG. 2. Each cross bar 130 and 132 will preferably rotate one hundred eighty degrees clockwise when going into the normal position as shown in FIG. 1. From their normal operating position such as shown in FIGS. 1, 4 and 5, each cross bar 130 and 132 may rotate approximately plus or minus thirty degrees (±30°).

FIG. 6 is a perspective view taken along lines 6—6 of transfer press 20 of FIG. 1 with portions broken away. Transfer press 20 includes a feed drive mechanism indicated generally at 44 for reciprocating cross bar assemblies 42*a* through 42*f* of FIGS. 1 and 2 on transfer rails 38 and 40. Feed drive mechanism 44 creates rotational motion and translates the rotational motion to provide linear motion for reciprocating cross bar assemblies 42*a* through 42*f* longitudinally in the direction of flow 30.

Feed drive mechanism 44 includes first and second feed drive motors 136 and 138, respectively for creating rotational motion. Feed drive motor 136 is coupled to feed drive gear box 140 by a torque tube 142. Similarly, feed drive motor 138 is coupled to feed drive gear box 144 through a torque tube 146. Feed drive gear boxes 140 and 144 are coupled together through coupling 148. Feed drive gear box 140 is coupled to an angle gear box 150 and feed drive gear box 144 is coupled to an angle gear box 152.

Angle gear box 150 is coupled to a spline shaft 154 for translating rotational motion of motors 136 and 138 to linear motion of carriages 126*a* through 126*f*. A pinion support housing 156 is coupled to transfer rail 38. Spline shaft 154 passes through pinion support housing 156. Similarly, a spline shaft 158 is coupled to angle gear box 152 for translating rotational motion provided by motors 136 and 138 to linear motion of carriages 128*a*, through 128*f* as described below. A pinon support housing 160 is coupled to transfer rail 40. Spline shaft 158 passes through pinion support housing 160. Spline shaft 154 is held in place by support members 162 and 164 coupled to vertical column 94*c*. Similarly, spline shaft 158 is held in place by support members 166 and 168. Support members 166 and 168 are coupled to vertical column 94*d*.

Figure 7:
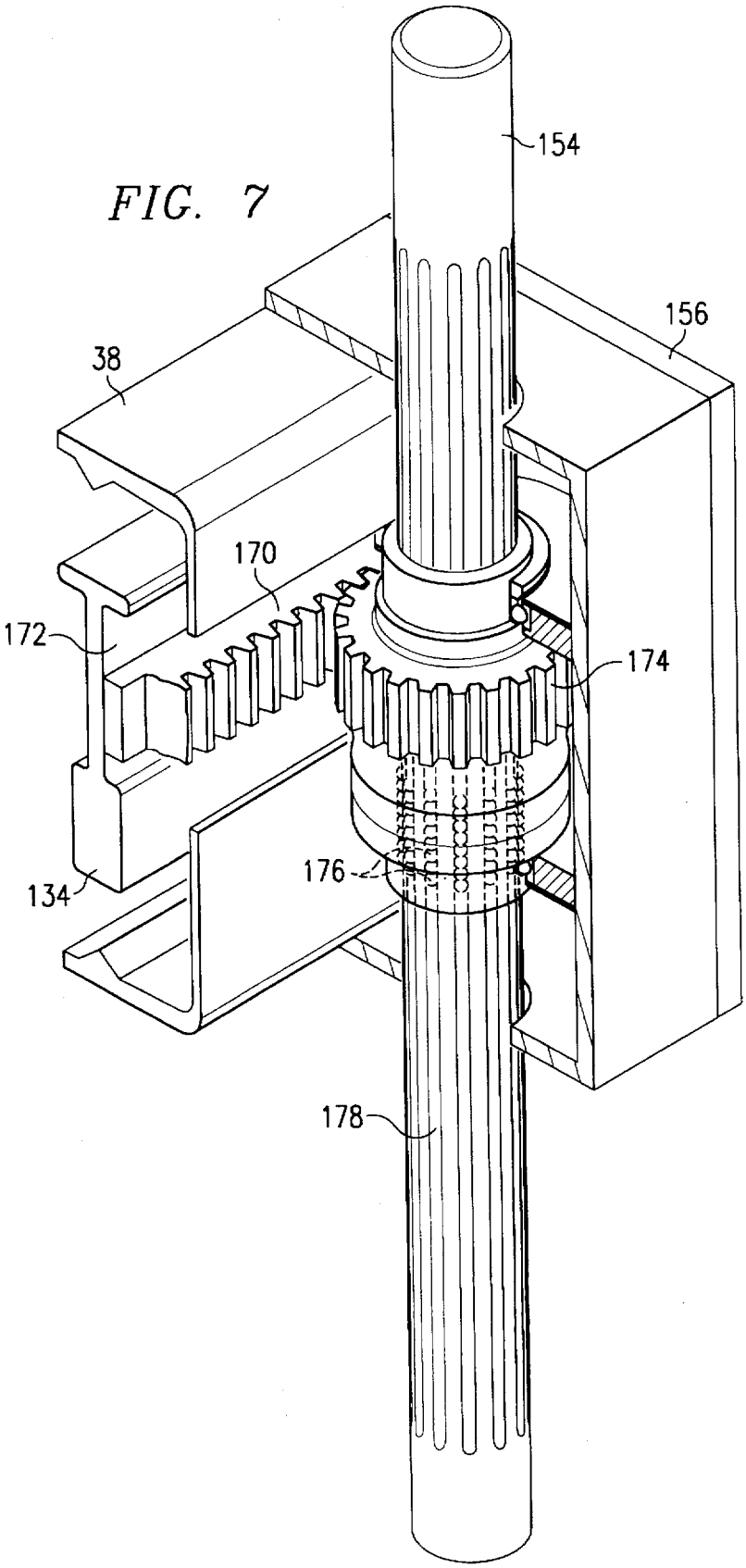
FIG. 7 is a perspective view in partial section of a portion of the transfer drive mechanism of the multiple station transfer press of FIG. 1 constructed according to teachings of the present invention.

FIG. 7 is an enlarged view of a portion of feed drive mechanism 44 at an interface with transfer rail 38 and an adjacent spacing member 134. It is understood that feed drive mechanism 44 similarly interfaces with an adjacent spacing member 134 and transfer rail 40. As shown, a rack 170 is provided along backside 172 of the adjacent spacing member 134. Rack 170 is engaged by a pinion 174 in pinion support housing 156. As transfer rail 38 is raised and lowered, pinion support housing 156 and pinion 174 raise and lower on spline shaft 154. This motion is allowed in part by a plurality of ball bearings 176 disposed in pinion support housing 156 along a length of shaft 154 in grooves 178. Additionally, pinion 174 is operable to rotate with spline shaft 154 to translate rotational motion of shaft 154 into linear motion of rack 170 and the adjacent spacing member 134.

In operation, transfer rail 38 is raised and lowered by vertical lift assemblies 48*a*, 48*b* and 48*c*. Pinion support housing 156 is similarly raised and lowered on spline shaft 154 in conjunction with the motion of transfer rail 38. Feed drive mechanism 44 moves cross bar assemblies 42*a* through 42*f* along transfer rails 38 and 40 in a horizontal direction. Drive motors 136 and 138 create rotational motion which is transmitted to spline shafts 154 and 158 by gear boxes 140, 144, 150, and 152. Pinions 174 rotate within pinion housings 156 and 160. Pinions 174 engage racks 170 to translate rotational motion of spline shafts 154 and 158 into linear motion of cross bar assemblies 42*a* through 42*f*.

FIGS. 8A through 8G illustrate a method for transferring work piece 22 through transfer press 20. For purposes of clarity, the method of transferring work piece 22 within transfer press 20 is only described with respect to the movement of cross bar assembly 42*b* between press stations 24*a* and 24*b*. It is understood that cross bar assemblies 42*a* and 42*c* through 42*f* operate in a similar manner between a loading station at entry side 26 and press station 24*a*, between adjacent press stations 24*c* through 24*e*, and between press station 24*e* and an unloading station (not expressly shown) at exit side 28. The method of operation illustrated generally in FIGS. 8A through 8G results in increased production rates for transfer press 22 over conventional systems.

Figure 8A:
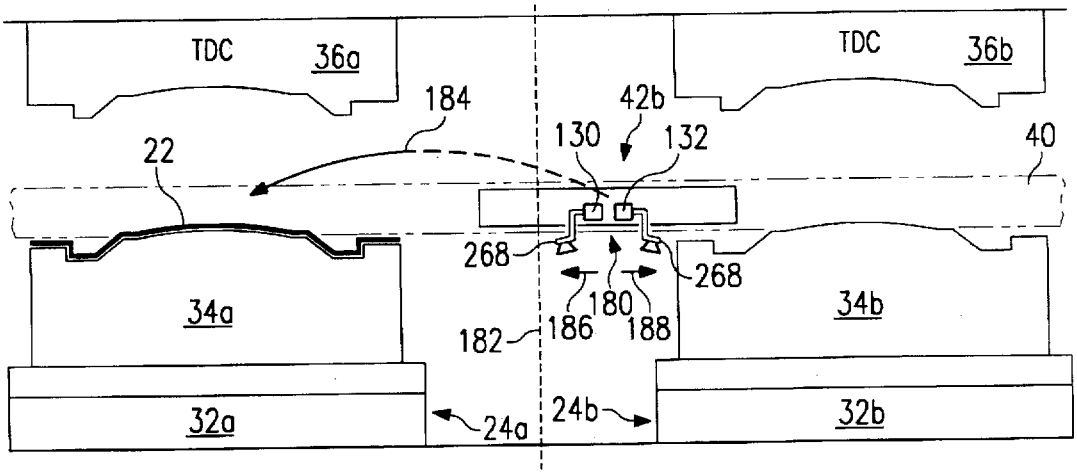
FIGS. 8A through 8G illustrate a method of transferring a work piece between adjacent press stations in the multiple station transfer press of FIG. 1 according to teachings of the present invention.

As shown in FIG. 8A, cross bar assembly 42*b* begins with first and second cross bars 130 and 132 located in close proximity to one another. Cross bar assembly 42*b* is located at a first rest position 180 between adjacent press stations 24*a* and 24*b*. First rest position 180 is located adjacent to second press station 24*b*. This means that rest position 180 is located on the side of a midpoint 182 between adjacent press stations 24*a* and 24*b* that is closer to press station 24*b*.

When a press operation is completed, upper dies 36*a* and 36*b* begin to separate from lower dies 34*a* and 34*b*, respectively. Cross bar assembly 42*b* then follows a path approximated by arrow 184 to engage work piece 22 in press station 24*a*. The curved motion represented by arrow 184 is obtained by simultaneously raising and then lowering transfer rails 38 and 40 while moving cross bar assembly 42*b* along transfer rails 38 and 40 toward press station 24*a*.

The dashed portion of arrow 184 represents motion of cross bar assembly 42*b* that occurs before upper die 36*a* reaches its top dead center (TDC) position. Movement of cross bar assembly 42*b* prior to upper die 36*a* reaching its top dead center position allows the method of the present invention to increase the throughput capability of transfer press 20. Cross bar assembly 42*b* preferably reaches a maximum speed upon entering press station 24*a*. Then, cross bar assembly 42*b* decelerates as it lowers down to engage work piece 22. Additionally, cross bars 130 and 132 separate in directions indicated by arrows 186 and 188 as cross bar assembly 42*b* follows the path shown by arrow 184.

Figure 8B:
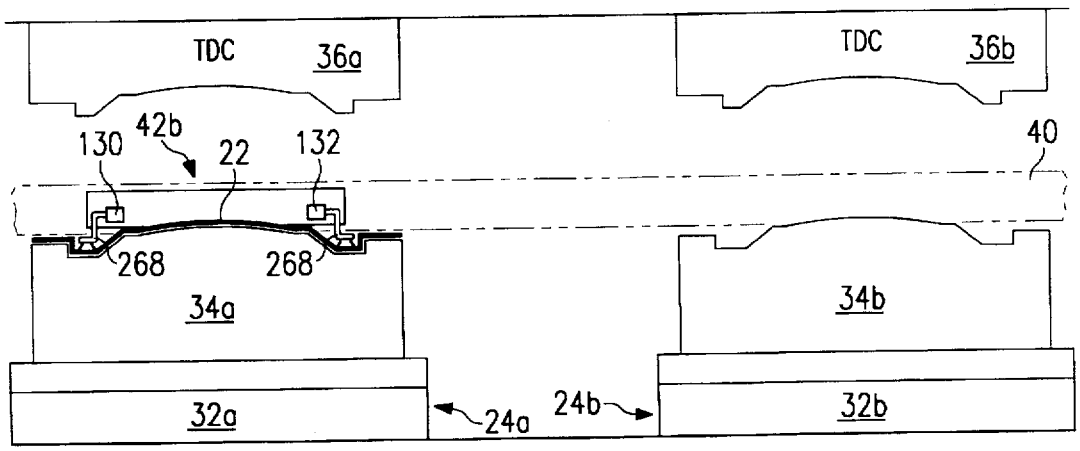
Figure 8C:
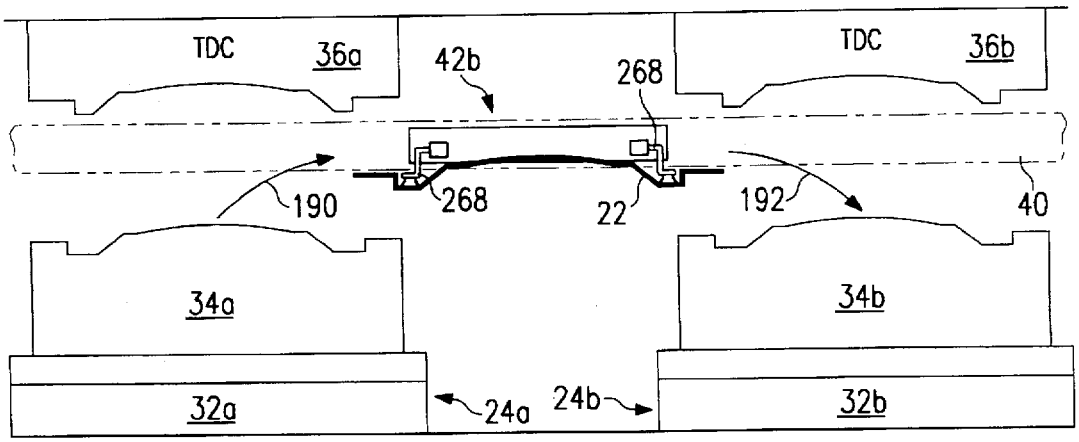

As shown in FIG. 8B, holding devices 268, which extend from cross bars 130 and 132, engage work piece 22 which is resting on bottom die 34*a* at press station 24*a*. At this time, upper dies 36*a* and 36*b* are located in their respective top dead center position. As shown in FIG. 8C, work piece 22 is transported to press station 24*b* by cross bar assembly 42*b* over a curved path represented by arrows 190 and 192. Again, the curved motion of cross bar assembly 42*b* is caused by the simultaneous vertical movement of transfer rails 38 and 40 and horizontal movement of cross bar assembly 42*b*.

Figure 8D:
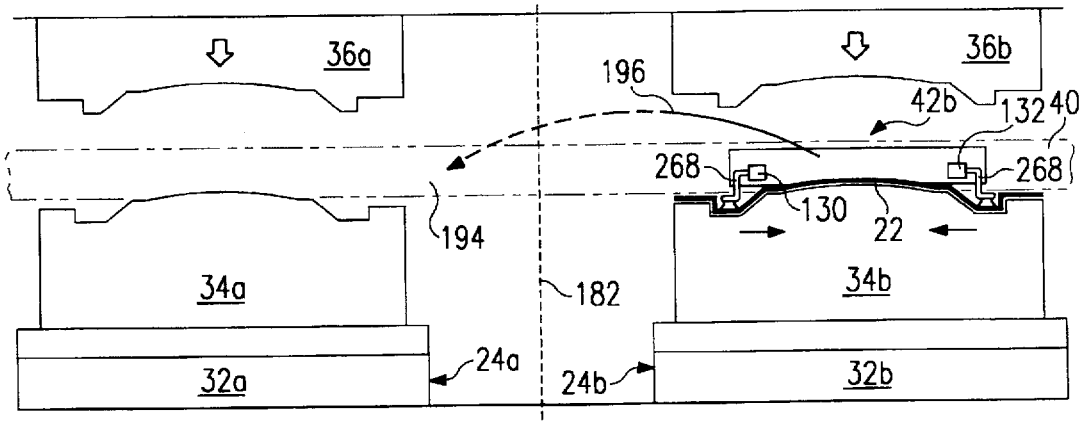

As shown in FIG. 8D, cross bar assembly 42*b* deposits work piece 22 on lower die 34*b*. After work piece 22 has been released from holding devices 268, cross bar assembly 42*b* moves to a second rest position 194 along a path indicated by arrow 196. The portion of arrow 196 represented by a solid line indicates motion of cross bar assembly 42*b* and transfer rails 38 and 40 while upper dies 36*a* and 36*b* are moving from top dead center.

Once cross bar assembly 42*b* exits press station 24*b*, upper die 36*b* continues to descend down to perform an operation on work piece 22. During the operation of upper die 36*b*, cross bar assembly 42*b* continues to move along the path represented by the dashed portion of arrow 196 to second rest position 194. It is noted that second rest position 194 is located adjacent to first press station 24a. This means that second rest position 194 is located on a side of midpoint 182 between press stations 24a and 24b that is closer to press station 24a. Cross bar assembly 42a will preferably place a second work piece 22 on lower die 34a while cross bar 42b is moving a first work piece 22 from lower die 34a to lower die 34b.

Figure 8E:
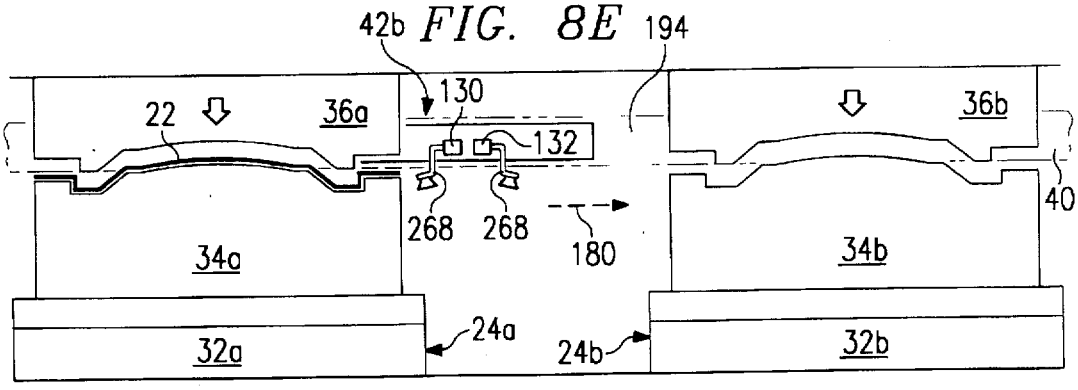
Figure 8F:
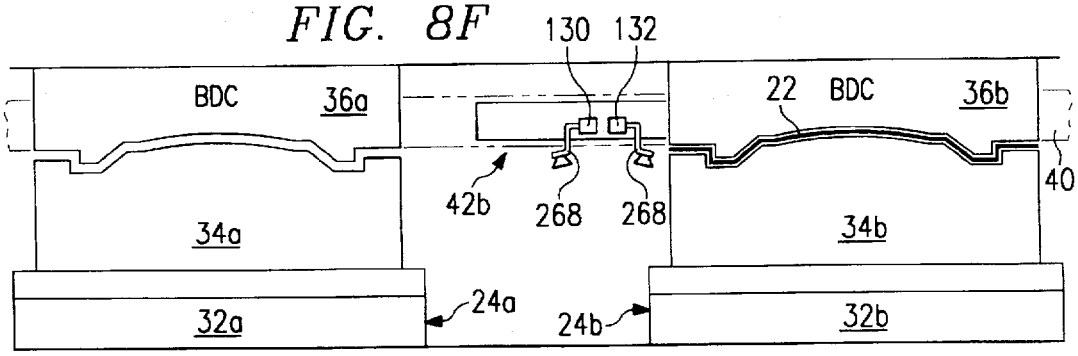

As shown in FIG. 8E, cross bar assembly 42b returns to first rest position 180 as upper dies 36a and 36b descend toward lower dies 34a and 34b. As shown in FIG. 8F, cross bar assembly 42b is located adjacent to press station 24b in first rest position 180 when upper dies 36a and 36b are located in their respective bottom dead center (BDC) position. The method then repeats the steps shown in FIGS. 8A through 8F to move additional work pieces 22 through transfer press 20.

Figure 8G:
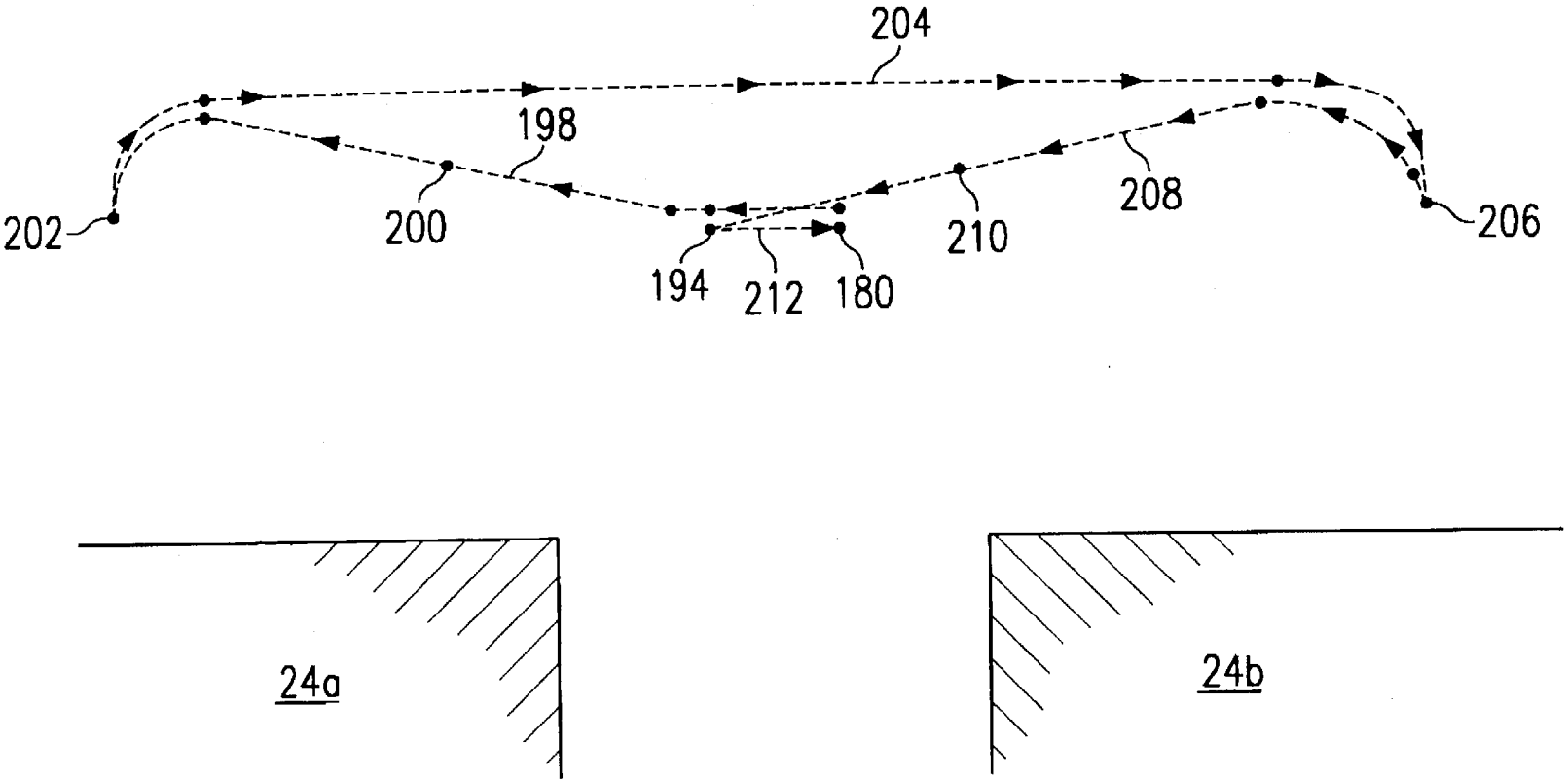

FIG. 8G summarizes the path of cross bar assembly 42b as described with respect to FIGS. 8A through 8F. Cross bar assembly 42b begins in first rest position 180. Cross bar assembly moves along path 198 and cross bars 130 and 132 begin to separate at point 200. Cross bar assembly 42b continues along path 198 and holding device 268 engages work piece 22 at press station 24a at point 202. Cross bar assembly 42b transfers work piece 22 to press station 24b along path 204 and holding device 268 release work piece 22 at point 206. Cross bar assembly 42b then returns to second rest position 194 along path 208. At point 210, cross bars 130 and 132 are back to their initial separation. Cross bar assembly 42b then returns to the first rest position 180 along a path 212.

A portion of the movement of cross bar assemblies 42a through 42f is accomplished while upper dies 36a through 36e are in motion between their respective top dead center and bottom dead center positions. This decreases the time required to move each work piece 22 between adjacent press stations 24 and thus increases the production rate of transfer press 20. Additionally, the method according to teachings of the present invention uses two rest positions 180 and 194 for each cross bar assembly 42a through 42f to allow cross bar assemblies 42a through 42f to enter and exit respective press stations 24a through 24e at an increased speed.

Figure 9A:
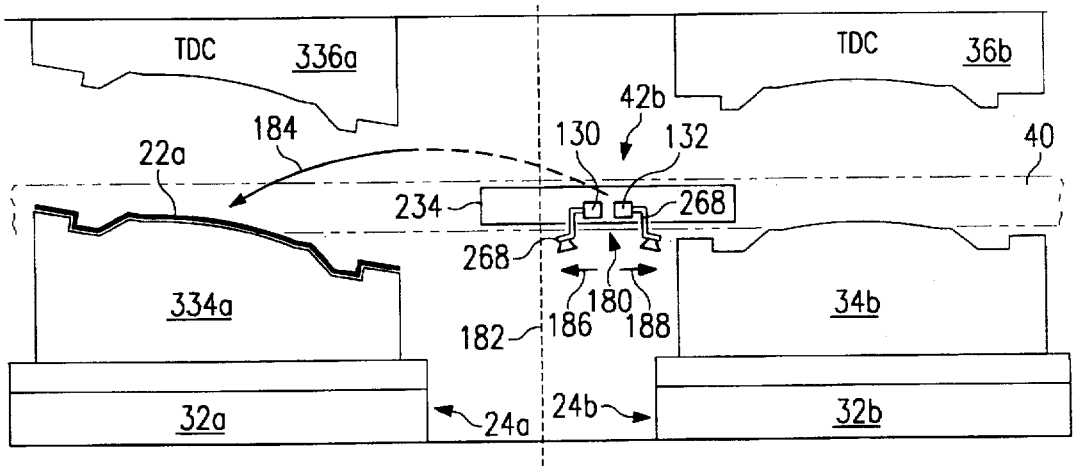
FIGS. 9A and 9B are schematic drawings showing a method of transferring a work piece between adjacent press stations in the multiple station transfer press of FIG. 1 according to teachings of the present invention.
Figure 9B:
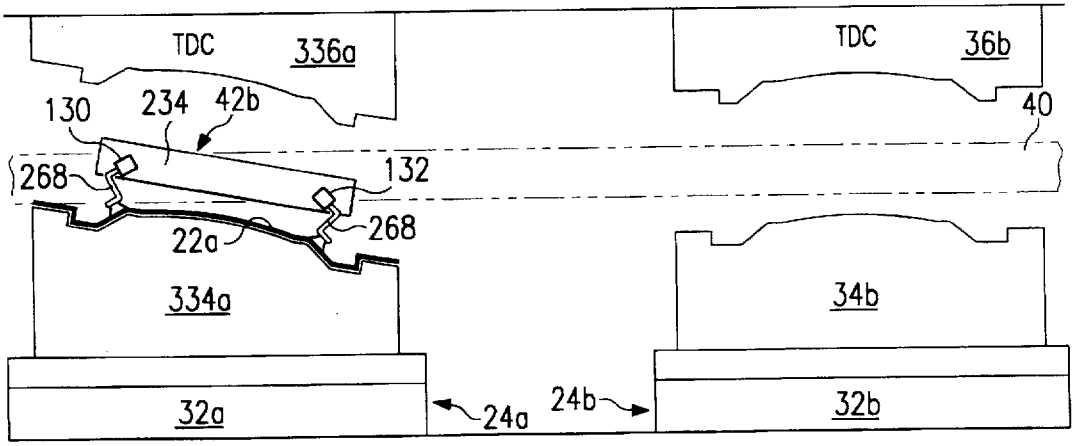

FIGS. 9A and 9B illustrate the operation of cross bar assembly 42b in a manner similar to FIGS. 8A and 8B. As shown in FIG. 9A, upper die 336a and lower die 334a at press station 24a have a substantially different configuration as compared to upper die 36aand lower die 34a shown in FIG. 8A. Mating surfaces or working surfaces 332 of upper die 336a and lower die 334a are inclined at an angle relative to the direction of flow 30.

As best shown in FIG. 9B, horizontal member 234 of cross bar assembly 42b has been tipped relative to transfer rail 40 and each cross bar 132 and 130 has been independently rotated relative to its longitudinal axis 384. Thus, holding devices 268 can engage work piece 22a at a different location and with a different orientation as compared to work piece 22 shown in FIG. 8B. Cross bar assembly 42b can then move work piece 22a to press station 24b as previously described with respect to FIGS. 8C and 8D.

Figure 9C:
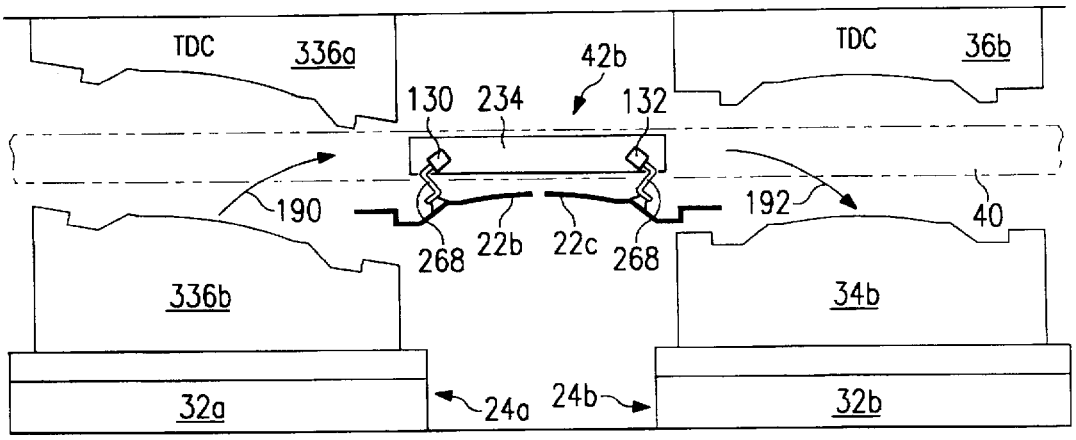
FIG. 9C is a schematic drawing similar to FIGS. 9A and 9B showing a method of transferring two separate work pieces between adjacent press stations.

FIG. 9C illustrates additional important features of the present invention. Each cross bar 130 and 132 has been individually rotated relative to their respective longitudinal axis 384 to accommodate the configuration of upper die 336a and lower die 336b. In addition, a first work piece 22b is releasably engaged by holding device 268 of cross bar 130 and a second work piece 22c is releasably engaged with holding device 268 of cross bar 130. FIG. 9C demonstrates that cross bar assembly 42b can be used to transfer more than one work piece between adjacent press stations 24a and 24b.

Figure 10:
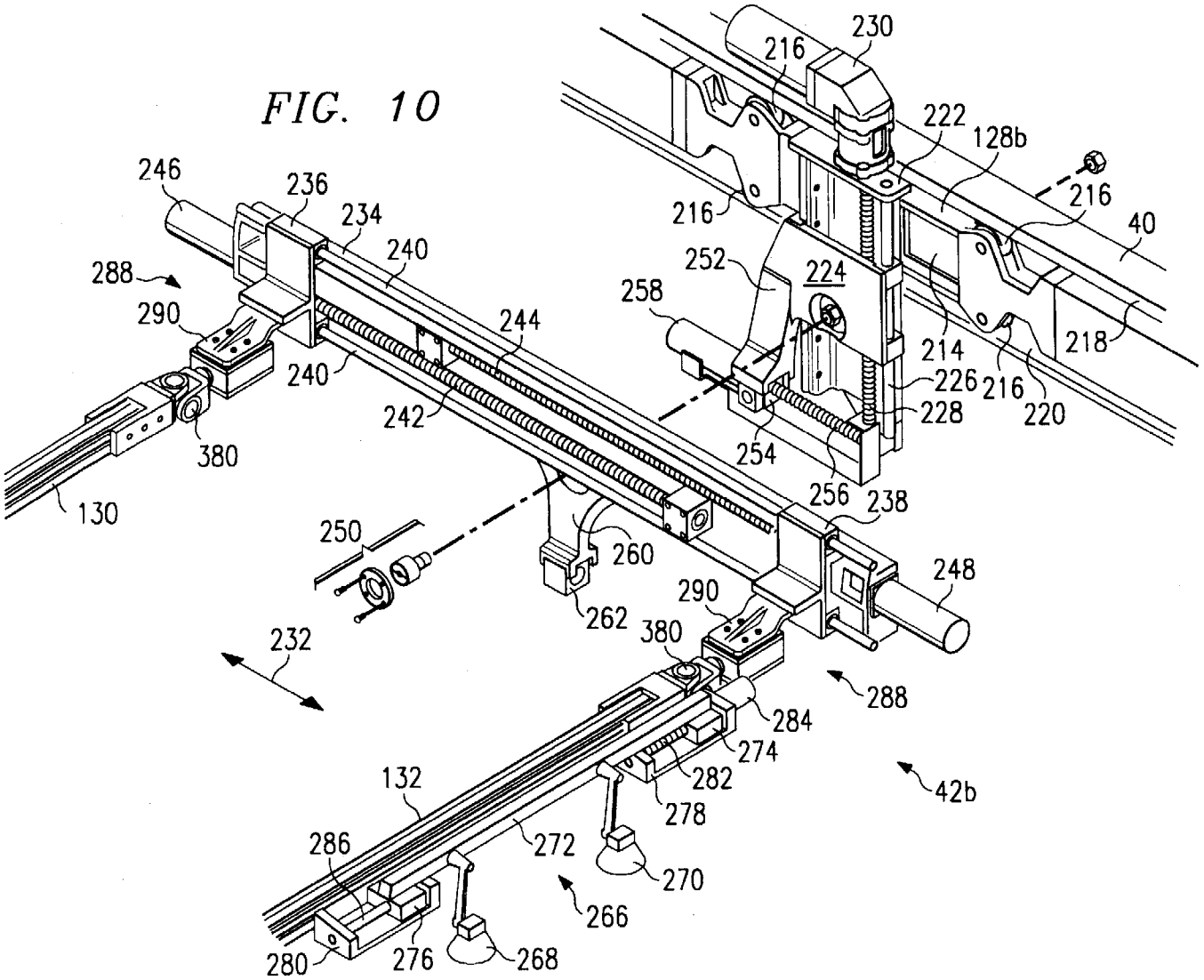
FIG. 10 is an exploded, perspective view of a cross bar assembly constructed according to teachings of the present invention for use in the multiple station transfer press of FIG. 1.

FIG. 10 is an exploded, perspective view of a cross bar assembly indicated generally at 42b and constructed according to teachings of the present invention. It is noted that FIG. 10 only shows the end of cross bar assembly 42b adjacent to the rear side of transfer press 20. The portions of cross bar assembly 42b shown in FIG. 10 are equally applicable to cross bar assemblies 42a, and 42c through 42f. As described with respect to FIGS. 8A through 8G, cross bar assembly 42b reciprocates on transfer rails 38 and 40 between adjacent press stations 24a and 24b to move work pieces 22 through transfer press 20 to create a desired part at exist side 28. Cross bar assembly 42b and associated cross bars 130 and 132 cooperate with each other to dynamically orient each work piece 22 during transfer between adjacent press stations 24a and 24b and to properly position each work piece 22 for the receiving press station 24b.

Linear movement of cross bar assembly 42b is provided by carriage 128b as previously described. Carriage 128b comprises a main body 214. A plurality of rollers 216 are rotatably disposed in top and bottom pairs on opposite ends of main body 214. Rollers 216 slidably engage tracks 218 and 220 on transfer rail 40. Tracks 218 and 220 maintain carriage 128b on transfer rail 40 and allow only reciprocating motion generally parallel to the direction of flow 30 as indicated by arrow 232.

Carriage 128b allows for vertical, horizontal and limited rotational orientation of cross bars 130 and 132. Cross bar assembly 42b comprises a vertical member 222 coupled to carriage 128b. A vertical slide 224 is coupled to vertical member 222 and is operable to translate from top to bottom of vertical member 222. Slide 224 translates on rods 226. Additionally, a lead screw 228 extends from top to bottom in vertical member 222. Lead screw 228 is rotated by motor 230 extending from the top of vertical member 222.

In operation, cross bar assembly 42b adjusts the height of associated cross bars 130 and 132 at carriage 128b. Motor 230 rotates lead screw 228 by a predetermined amount to move vertical slide 224 up or down on rods 226 of vertical member 222. This motion establishes a desired height for cross bar assembly 42b which may sometimes be referred to as passline height adjustment.

Cross bars 130 and 132 may each independently move relative to each other as indicated by arrow 232. Cross bar assembly 42b comprises a horizontal member 234 that is pivotally coupled to slide 224 of vertical member 222. Horizontal slides 236 and 238 are slidably coupled to horizontal member 234 on horizontal rods 240. Horizontal member 234 further includes first and second lead screws 242 and 244. Lead screws 242 and 244 are disposed along a length of horizontal member 234 such that lead screws 242 and 244 overlap over a portion of the length of horizontal member 234. Lead screws 242 and 244 are controlled by servo motors 246 and 248, respectively.

In operation, cross bars 130 and 132 may move together and apart on horizontal member 234. For example, lead screw 242 moves cross bar 130 toward or away from cross bar 132. Motor 246 rotates lead screw 242. Horizontal slide 236 thus moves along lead screw 242 toward or away from cross bar 132. Similarly, cross bar 132 moves toward or away from cross bar 130. Motor 248 rotates lead screw 244. Based on the rotation of lead screw 244, horizontal slide 238 either moves toward or away from cross bar 130.

Horizontal member 234 is preferably pivotally coupled to vertical slide 224 by a pivot screw assembly 250 to allow limited rotation of horizontal member 234 relative to vertical slide 224. Rotation lever 252 extends from vertical slide 224. Pivot block 254 is pivotally coupled to an end of rotation lever 252. Lead screw 256 extends from a motor 258 through pivot block 254 to provide rotational movement of horizontal member 234 on vertical slide 224. Additionally, lead screw support member 260 extends from horizontal member 234. Bearing block 262 is pivotally coupled to an end of lead screw support 260 and has an opening 264 for receiving lead screw 256.

When servo motor 258 rotates lead screw 256 in bearing block 262 and pivot block 254, the distance between pivot block 254 and bearing block 262 changes thus causing horizontal member 234 to pivot on vertical side 224. As a result limited rotation or tipping of cross bar assembly **42*b* relative to transfer rails 40 is provided. Also, each end of cross bar assembly 42*b* adjacent to transfer rail 38 or 40 may be independently raised or lowered to tilt cross bar assembly 42*b***.

Figure 11:
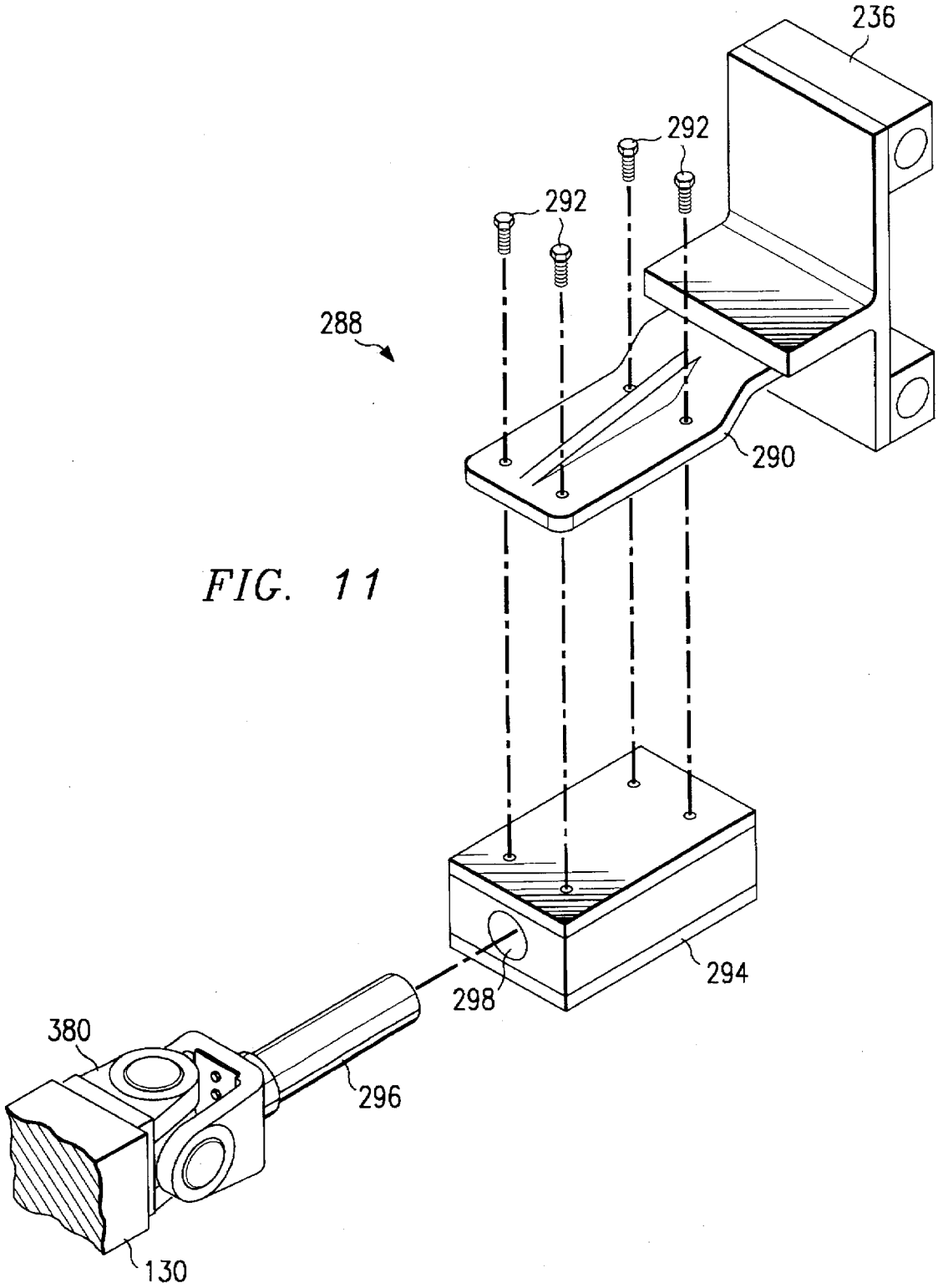
FIG. 11 is a schematic drawing showing an exploded, perspective view of a bearing assembly constructed according to teachings of the present invention for coupling a cross bar to a horizontal member in the cross bar assembly of FIG. 4 to allow rotation of the associated cross bar relative to the horizontal member.

A plurality of holding devices 268 and 270 are preferably attached to or mounted on each cross bar 130 and 132. For the embodiment of the present invention as shown in FIGS. 4 and 11, each cross bar 130 and 132 preferably includes two vacuum cup assemblies 266. Each vacuum cup assembly 266 in turn comprises first vacuum cup 268 and second vacuum cup 270. The number of vacuum cup assemblies 266 and the number of vacuum cups 268 and 270 included within each vacuum cup assembly 266 may be varied depending upon the width of transfer press 20, the size of each work piece 22 and/or the number of individual work pieces 22 which will be simultaneously transferred by the resulting cross bar assembly 42. Also, for some applications holding devices other than vacuum cups 268 and 270 may be satisfactorily used with the present invention. Only one vacuum cup assembly 266 is shown for purposes of illustration in FIG. 10.

Vacuum cups 268 and 270 are preferably coupled to vacuum cup support 272. Transverse slides 274 and 276 are coupled at opposite ends of vacuum cup support 272. Additionally, transverse slides 274 and 276 rest within transverse slide supports 278 and 280, respectively. A lead screw 282 extends through transverse slide 274 from end to end of transverse slide support 278. A motor 284 is coupled to lead screw 282. Additionally, a slide rod 286 extends between the ends of transverse slide support 280 and passes through transverse slide 276.

In operation, vacuum cups 268 and 270 may be positioned along cross bar 132 by vacuum cup assembly 266 by motor 284 rotating lead screw 282. Thus, transverse slide block 274 causes vacuum cup support 272 to translate along the length of cross bar 132. Transverse slide 276 similarly slides along rod 286. The length of transverse slide supports 278 and 280 limits the range of motion of the respective vacuum cup assembly 266.

FIG. 11 illustrates an embodiment of a bearing assembly indicated generally at 288 for use in coupling each cross bar 130 and 132 to horizontal member 234 of the associated cross bar assembly 42. Bearing assembly 288 is described in conjunction with cross bar 130 for convenience only. Bearing assembly 288 is located at the rear portion of cross bar assembly 42 for both cross bars 130 and 132.

Bearing assembly 288 comprises bracket 290 which is attached to and extends from horizontal slide 236. Four bolts 292 extend through appropriately sized holes in bracket 290 to attach linear bearing 294 thereto. Thus, horizontal slide 236, bracket 290 and linear bearing 294 are securely fixed to each other.

The end of cross bar 130 adjacent to the rear portion of the associated cross bar assembly 42 includes universal joint 380 with a generally cylindrical shaft 296 extending therefrom. The dimensions of shaft 296 are selected to fit within opening 298 of linear bearing 294. A plurality of ball bearings (not expressly shown) are preferably provided within linear bearing 294 to accommodate both longitudinal and rotational movement of shaft 296 within opening 298 of linear bearing 294. Bearing assembly 288 cooperates with servo motor 382 to allow polar rotation of cross bar assembly 130. Bearing assembly 288 also accommodates tipping and tilting of the associated cross bar assembly 42 by allowing longitudinal movement of cross bar 130 relative to horizontal member 234. Bearing assembly 288 in effect allows the length of cross bar 130 to be increased when the height of cross bar 130 is not the same at both ends of the associated cross bar assembly 42, or when the ends of cross bar 130 are not aligned perpendicular to the adjacent horizontal member 234. Bearing assembly 288 in cooperation with universal joints 380 allow cross bar 130 to be oriented at an angle other than perpendicular to the direction of flow 30.

FIGS. 12A through 12F illustrate various orientations that cross bar assembly 42 and its associated cross bars 130 and 132 may achieve as a result of incorporating teachings of the present invention. Each of the possible movements of cross bar assembly 42 as previously described may be independently programed in a control system (not expressly shown) for transfer presses 20, to achieve a desired orientation with respect to a specific work piece 22 and die set. Thus, a technical advantage of the present invention includes cross bar assemblies **42*a* through 42*f* programmed independently to provide a desired orientation of a work piece 22 for each press station 24*a* through 24*e*. In any particular application of cross bar assembly 42, the various orientations shown in FIGS. 12A through 12F may be combined or modified to achieve other desired orientations. It is thus understood that the orientations in FIGS. 12A through 12F are shown by way of example and not by way of limitations and do not illustrate all possible orientations of cross bar assembly 42**.

Figure 12A:
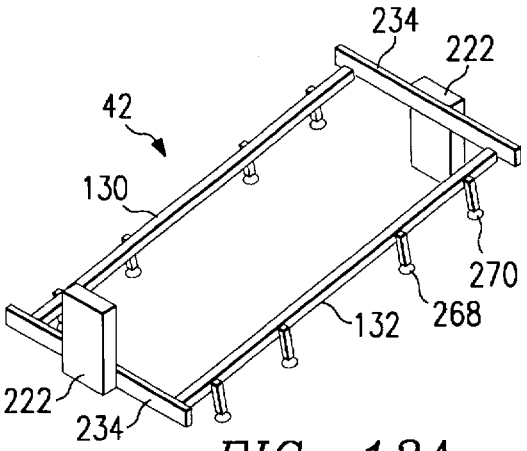
FIGS. 12A through 12F illustrate various orientations of the associated cross bars that may be achieved with the cross bar assembly of FIGS. 4 and 5 to allow dynamically orienting a work piece between adjacent press stations in the multiple station transfer press of FIG. 1 according to teachings of the present invention.
Figure 12B:
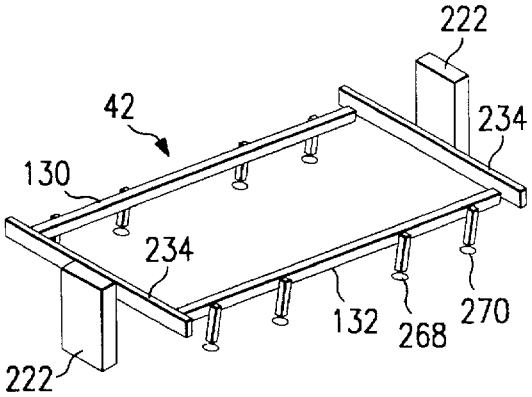

A technical advantage of the present invention is that cross bar assembly 42 can be programmed to tilt a work piece 22 in a direction that is perpendicular to the direction of flow 30. FIGS. 12A and 12B illustrate this orientation wherein horizontal members 234 translate up and down on respective vertical members 222. Another technical advantage of the present invention is that cross bars 130 and 132 may be programmed to be raised and lowered together by movement of horizontal members 234. Thus, cross bar assemblies **42*a* through 42*f* may raise or lower work piece 22 irrespective of the movement of transfer rails 38 and 40**.

Figure 12C:
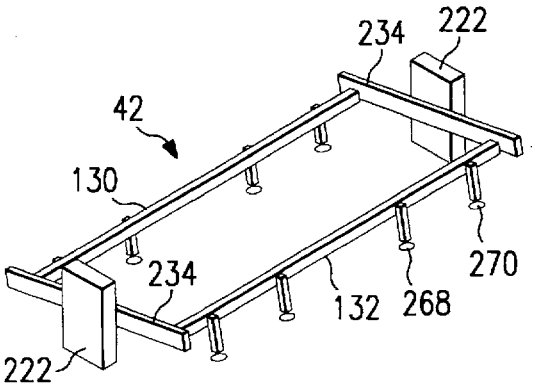
Figure 12D:
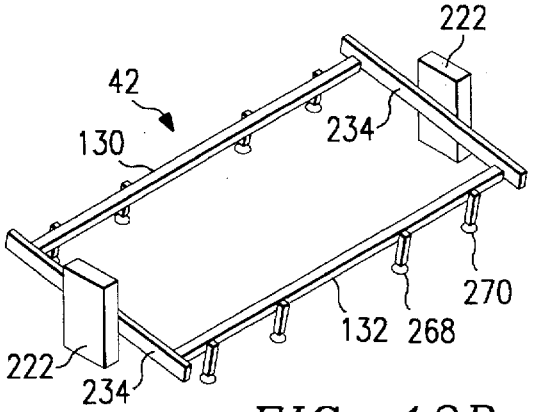

Another technical advantage of the present invention is that cross bar assembly 42 can be programmed to tip in the direction of flow 30 of transfer press 20. FIGS. 12C and 12D illustrate this orientation which is achieved by rotating horizontal member 234 relative vertical member 222 and transfer rails 38 and 40.

Figure 12E:
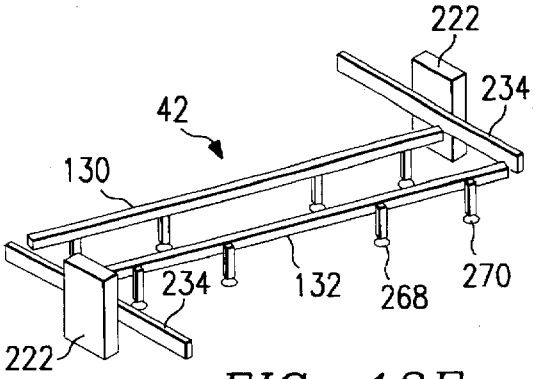
Figure 12F:
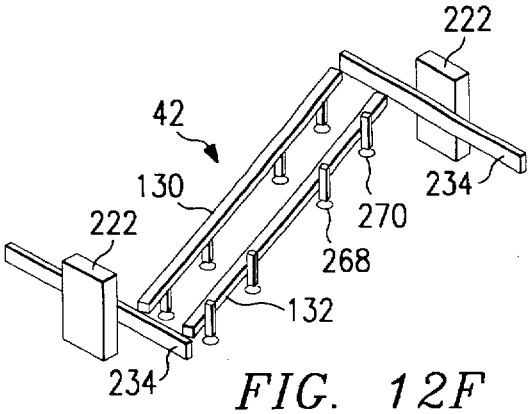

FIGS. 12E and 12F illustrate independent programmable movement of cross bars 130 and 132 on horizontal members 234. FIGS. 12E and 12F show that cross bars 130 and 132 can be maintained in a plane parallel with the direction of flow 30 and angled relative to the direction of flow 30.

Movement of cross bars 130 and 132 on horizontal members 234 provides another technical advantage. Such horizontal movement of cross bars 130 and 132 allows press station 24*a* through 24*e* to be spaced apart by non-uniform distances. The horizontal movement of cross bars 130 and 132 allows a portion of the non-uniform transfer distance between adjacent press stations 24 to be traversed by motion of cross bars 130 and 132 on horizontal members 234 of cross bar assembly 42.

As a result of the present invention transfer press 20 provides eight degrees of freedom with respect to the orientation of cross bars 130 and 132 and holding devices 268 and 270 attached thereto. These eight degrees of freedom may be summarized as follows:

Anticipation. Cross bars 130 and 132 spread as they approach the open die space, anticipating pick-up of work piece 22, making maximum use of open die time. Upon exit after releasing work piece 22, cross bars 130 and 132 close allowing minimal space between press stations 24. Cross bars 130 and 132 enable shorter outriggers, thereby creating stability during high-speed acceleration of an attached work piece 22 to and from the adjacent press station 24. See FIGS. 8A and 8F.

Adjust off Center. Cross bars 130 and 132 can shift work piece 22 in relation to the centerline at each press station 24. For example, cross bars 130 and 132 can pick up work piece 22 that was centered on lower die 34*a* and deposit work piece 22 to the right or left of the centerline for lower die 34*b* since holding devices 268 and 270 may move along the length of the associated cross bars 130 and 132.

Trapezoidal Parts. Since cross bars 130 and 132 can move closer together on horizontal members 234 at either the front side or rear side of the respective cross bar assembly 42, cross bars 130 and 132 can easily align themselves with work pieces 22 that have irregular shapes, such as trapezoids.

Passline Height Adjustment. The ends of the cross bars 130 and 132 can be raised or lowered by motors 230 and vertical slides 224 as cross bars 130 and 132 move between dies without raising or lowering transfer rails 38 and 40. Thus, the vertical position of each work piece 22 can vary in height from one press station 24 to the next press station 24 as required for the respective die set passline.

Separation. The vacuum cups or suction cups 268 and 270 can move independently along the length of 130 and 13 130 and 132. Thus, suction cups 268 and 270 can deposit a single work piece 22, then pick up aid separate two work pieces 22 in preparation for the next operation.

Tip ±15° Left to Right. Each cross bar assembly 42 can rotate ±15° in the direction of flow 30, allowing work piece 22 to be rotated from one press station 24 to the next. See FIGS. 12C and 12D.

Tilt ±7° Front to Rear. Each end of each cross bar assembly 42 can be independently raised and lowered, to tilt an attach work piece 22±7°. See FIGS. 12A and 12B.

Polar Rotation of Each Cross Bar. Servo motors 282 in cooperation with the respective bearing assemblies 288 allow independent rotation of each cross bar 130 and 132 relative to their respective longitudinal axis 384. Encoder 386 provides accurate information concerning the angular orientation of holding devices 268 and 270 relative to the respective longitudinal axis 384. See FIGS. 13A, 13B and 14.

Figure 13A:
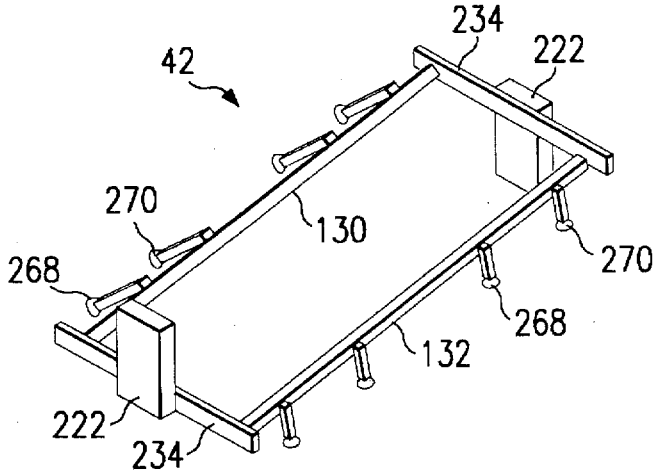
FIGS. 13A and 13B are schematic drawings showing various cross bar orientations including polar rotation of each cross bar of the cross bar assembly of FIGS. 4 and 5 to provide dynamic orientation of a work piece between adjacent press stations in the multiple station transfer press of FIG. 1 according to teachings of the present invention.
Figure 13B:
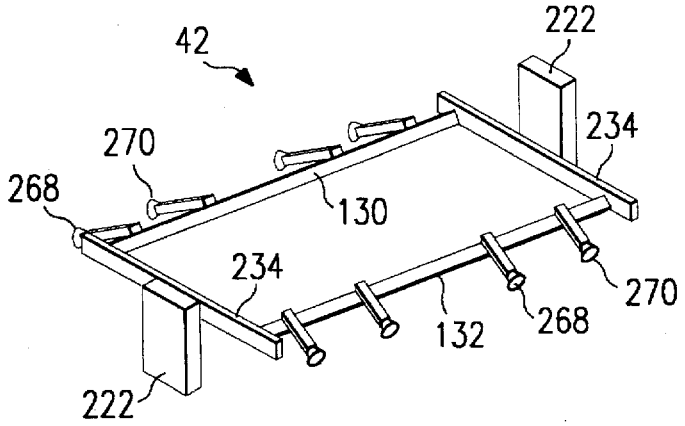

FIG. 13A shows cross bar assembly 42 with horizontal member 234 on the front side at a lower position than horizontal member 234 on the rear side. FIG. 13B shows cross bar assembly 42 tilted in the opposite direction. Also, each individual cross bar 130 and 132 has been individually rotated to provide the desired angular orientation for holding devices 268 and 270 relative to respective longitudinal axis 384. For one embodiment of the present invention, each cross bar 130 and 132 may rotate thirty degrees (30°) clockwise and up to one hundred and eighty degrees (180°) counterclockwise. The one hundred and eighty degree counterclockwise position is used during die changes and to replace the associated holding devices 268 and 270.

During normal operation of transfer press 20, each cross bar 130 and 132 will typically rotate plus or minus thirty degrees (±30°) relative to respective longitudinal axis 384. Mechanical stop 340 which will be described later in more detail is preferably included as part of the drive assembly between electrical motor 382 and each cross bar 130 and 132 to prevent twisting of electrical lines and/or vacuum hoses which may be attached to or carried by cross bars 130 and 132.

Figure 14:
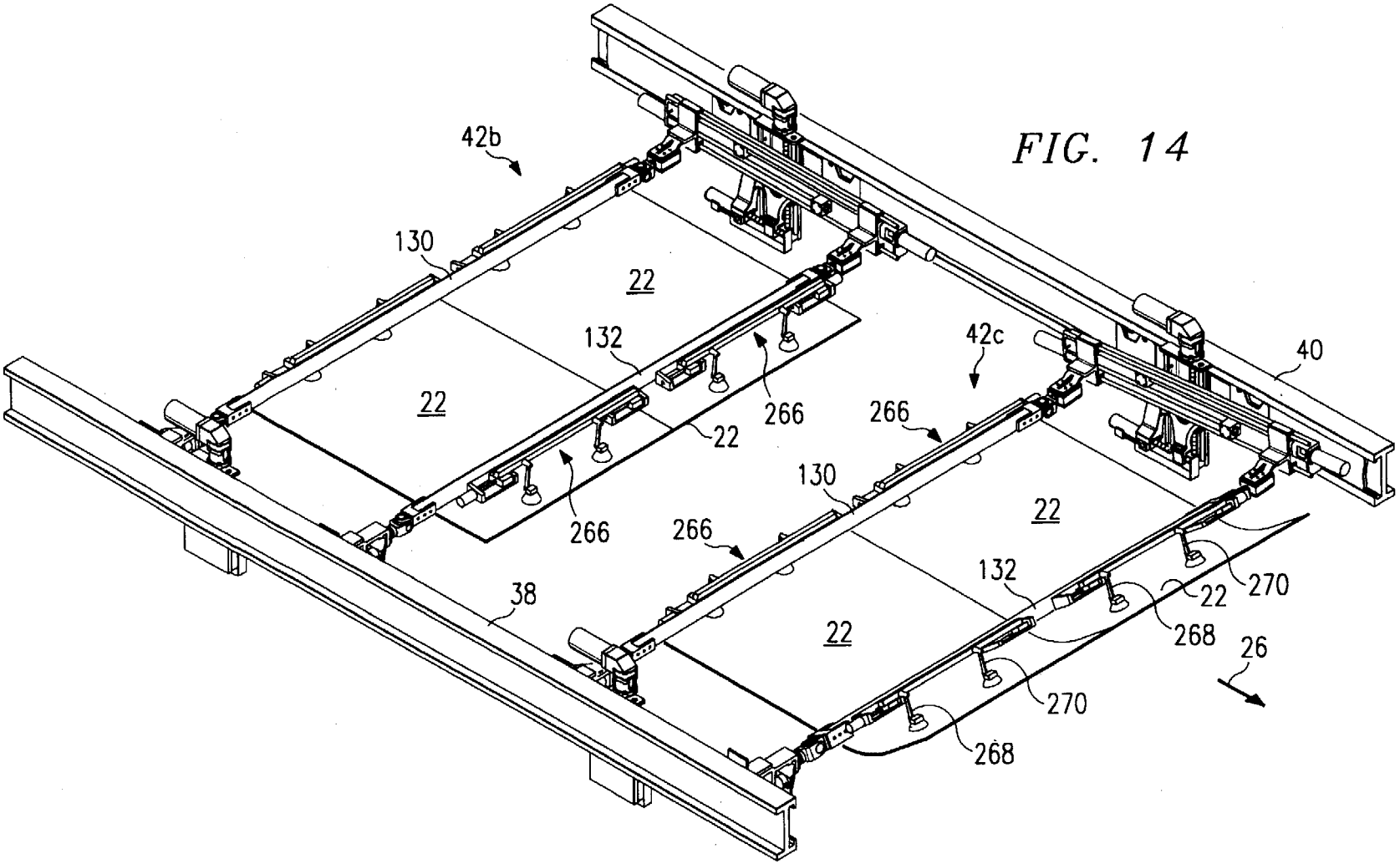
FIG. 14 is a schematic drawing showing a perspective view with portion broken away to illustrate polar rotation of an individual cross bar according to teachings of the present invention in the multiple station transfer press of FIG. 1.

A technical advantage of the present invention is that multiple work pieces 22 may be moved by a single cross bar assembly 42. Vacuum cup assemblies 266 are programmable to operate independently. As shown in FIG. 14, two work pieces 22 are releasably attached to cross bar assembly 42*b* by vacuum cup assemblies 266 in cooperation with cross bars 130 and 132 for movement to press station 24*b*. At press station 24*b*, each work piece 22 may be bent upwardly.

Cross bar assembly 42*c* is shown with two bent work pieces 22 attached thereto for movement from press station 24*b* to the next press station 24*c*. Cross bar 132 of crossbar assembly 42*c* has been rotated relative to its longitudinal axis 384 so that the associated holding devices 268 and 270 may be satisfactorily engaged with the bent portion of work pieces 22.

For the embodiment of the invention illustrated in FIG. 14, a large work piece may have been cut at press station 24*a* into the two individual work pieces 22 which are shown attached to cross bar assembly 42*b*. At another step in the process such as cross bar assembly 42*d*, the associated vacuum cup assemblies 266 may be used to separate work pieces 22 laterally from each other, (not expressly shown).

FIG. 15 is a schematic diagram with portions broken away showing an exploded view of electrical motor 382, gear box 378, encoder 386 and associated components coupled to cross bar 130 to provide for polar rotation of cross bar 130 and its associated holding devices 268 and 270 relative to longitudinal axis 384. Bracket 376 is used to couple the adjacent end of cross bar 130 to horizontal member 234 at the front side of the associated cross bar assembly 42.

For one application, gear 374 is attached to drive shaft 388 and a corresponding gear 372 engaged therewith. Gear 372 is attached to a shaft (not expressly shown) extending from encoder 386. Gears 372 and 374 cooperate with each other to provide information to encoder 386 concerning the angular orientation of cross bar 130 relative to its longitudinal axis 384. An important feature of the present invention is to ensure that all connections between electrical motor 382, drive shaft 388 and cross bar 130 are preferably very stiff with respect to any possibility of relative rotation between adjacent components. Also, gears 372 and 374 have relatively close tolerances to minimize any slippage or misalignment in the position information provided to encoder 386. For some applications, a mechanical brake (not expressly shown) is also included as part of the drive assembly used to rotate each cross bar 130 and 132. The mechanical brake is provided to hold the associated cross bar 130 and 132 in its respective position in the event of an electrical power failure to motor 382.

Mechanical stop 340 is preferably attached to drive shaft 380 as shown in FIG. 16. Key 370 extending from drive shaft 388 and slot 368 cooperate with each other to ensure that mechanical stop 340 rotates in unison with drive shaft 388 and cross bar 130. Projection 366 extends vertically from bracket 376. Mechanical stop 340 preferably includes tabs 342 and 344 which are radially offset from each other. FIG. 16 shows a view of drive shaft 388 which would correspond with looking at cross bar 130 from the front side towards the rear side of the associated cross bar assembly 42. Tab 344 allows drive shaft 388 and the attached cross bar 130 to rotate approximately thirty degrees (30°) clockwise. This position is shown by dotted lines in FIG. 16.

Tab 342 allows drive shaft 388 and attached cross bar 130 to rotate approximately one hundred and eighty degrees (180°) in the counterclockwise direction. This position is also shown by dotted lines in FIG. 16. Thus, mechanical stop 340, in cooperation with projection 366, prevents vacuum hoses and/or electrical lines which are attached to or carried by cross bar 130 from becoming twisted or damaged during the operation of transfer press 20.

It is noted that cross bar assembly 42 provides several other technical advantages for the present invention. For example, cross bar assembly 42 is not designed for a specific work piece 22. Rather, cross bar assembly 42 is generally applicable to a wide range of work pieces 22 having varying shapes and sizes. Furthermore, cross bar assembly 42 may include an overload sensor which releases cross bar 130 or 132 when it hits an interference thus reducing possible damage to transfer press 20.

Although the present invention has been described in detail, it should be understood that various changes, substitutions and alternations can be made hereto without departing from the spirit and scope of the invention as defined by the following claims.

What is claimed is:

1. A system for transferring a work piece between a first press station and a second press station in a multiple station transfer press having a plurality of associated upper and lower dies, the system comprising:

at least one cross bar assembly movable between the press stations in the direction of flow for the transfer press;

each cross bar assembly having at least one cross bar;

a plurality of holding devices coupled to the cross bar for removably engaging a work piece;

a transfer mechanism for moving the cross bar assembly from a rest position to the first press station;

the cross bar assembly and the holding devices operable to releasably engage a work piece at the first press station and to move and deposit the work piece at the second press station;

the transfer mechanism returning the cross bar assembly to the rest position to prepare for a subsequent work piece transfer;

an electrical motor carried by the cross bar assembly for selectively rotating the one cross bar; and a gear box connecting the electrical motor with one end of the one cross bar.

2. A system for transferring a work piece between a first press station and a second press station in a multiple station transfer press comprising:

a cross bar assembly movable between the press stations in the direction of flow for the transfer press;

the cross bar assembly having at least two cross bars;

a plurality of holding devices coupled to the cross bar for removably engaging a work piece;

a transfer mechanism for moving the cross bar assembly from a rest position to the first press station;

the cross bar assembly and the holding devices operable to releasably engage a work piece at the first press station and to move and deposit the work piece at the second press station;

the transfer mechanism returning the cross bar assembly to the rest position to prepare for a subsequent work piece transfer;

a first motor carried by the cross bar assembly for selectively rotating the one cross bar;

the two cross bars movable together and independently of one another; and a second motor carried by the cross bar assembly for selectively rotating the second cross bar independent of the one cross bar.

3. A system for transferring a work piece between a first press station and a second press station in a multiple station transfer press having a plurality of associated upper and lower dies, the system comprising:

at least one cross bar assembly movable between the press stations in the direction of flow for the transfer press;

each cross bar assembly having at least one cross bar:

a plurality of holding devices coupled to the cross bar for removably engaging a work piece;

a transfer mechanism for moving the bar assembly from a rest position to the first press station;

the cross bar assembly and the holding devices operable to releasably engage a work piece at the first press station and to move and deposit the work piece at the second press station;

the transfer mechanism returning the cross bar assembly to the rest position to prepare for a subsequent work piece transfer; and a first motor carried by the cross bar assembly for selectively rotating the one cross bar;

a pair of opposite carriages with the cross bar extending therebetween; and a bearing assembly for rotatably coupling one end of the cross bar with one of the carriages.

4. The system of claim 3, further comprising an angle encoder coupled with the one cross bar whereby the angle encoder provides a signal indicating the angular orientation of the one cross bar.

5. The system of claim 3, further comprising:

a drive shaft extending between the first motor and one end of the one cross bar opposite from the bearing assembly; and a mechanical stop attached to the drive shaft to limit angular rotation of the one cross bar.

6. The system of claim 3, further comprising:

a drive shaft extending between the first motor and one end of the one cross bar;

a mechanical stop attached to the drive shaft to limit rotation of the one cross bar; and an angle encoder coupled to the drive shaft to indicate the angular orientation of the one cross bar.

7. The system of claim 3, wherein the holding devices comprise vacuum cups and rotation of the one cross bar by the motor varies the angular orientation of the vacuum cups relative to a longitudinal axis of the one cross bar.

8. A system for transferring a work piece between a first press station and a second press station in a multiple station transfer press having a plurality of associated upper and lower dies, the system comprising:

at least one cross bar assembly movable between the press stations in the direction of flow for the transfer press;

each cross bar assembly having at least one cross bar;

a plurality of holding devices coupled to the cross bar for removably engaging a work piece:

a transfer mechanism for moving the cross bar assembly from a rest position to the first press station;

the cross bar assembly and the holding devices operable to releasably engage a work piece at the first press station and to move and deposit the work piece at the second press station;

the transfer mechanism returning the cross bar assembly to the rest position to prepare for a subsequent work piece transfer;

a first motor carried by the cross bar assembly for selectively rotating the one cross bar;

a drive shaft extending between the motor and one end of the one cross bar;

a mechanical stop attached to the drive shaft to limit angular rotation of the one cross bar;

the mechanical stop defined in part by a first tab to limit rotation of the one cross bar in a clockwise direction; and a second tab to limit rotation of the one cross bar in a counterclockwise direction.

9. A system for transferring a work piece between a first press station and a second press station in a multiple station press having a plurality of associated upper and lower dies, comprising:

at least one cross bar assembly movable between the press stations in the direction of flow for the transfer press;

each cross bar assembly having at least one cross bar;

a plurality of holding devices coupled to the one cross bar for removably engaging a work piece;

a transfer mechanism for moving the one cross bar assembly from a rest position to the first press station;

the cross bar assembly and the holding devices operable to releasably engage a work piece at the first press station and to move and deposit the work piece at the second press station;

the transfer mechanism returning the cross bar assembly to the rest position to prepare for a subsequent work piece transfer;

a first motor carried by the cross bar assembly for selectively rotating the one cross bar;

each cross bar assembly defined in part by a pair of opposite carriages with a first cross bar and a second cross bar extending therebetween;

the first motor carried by one of the carriages for independently rotating the first cross bar and a second motor carried by the one carriage for independently rotating the second cross bar;

a first bearing assembly for rotatably coupling one end of the first cross bar with the other carriage; and a second bearing assembly for rotatably coupling one end of the second cross bar with the other carriage.

10. The system of claim 9, further comprising:

each bearing assembly including a linear bearing and a bracket for attaching the linear bearing to the other carriage;

the one end of each cross bar adjacent to the bearing assembly including a universal joint with a generally cylindrical shaft extending therefrom; and each linear bearing having a generally circular opening to receive the cylindrical shaft extending from the one end of the respective cross bar whereby the bearing assembly and the cylindrical shaft cooperate with each other to allow rotational movement and linear movement of the respective cross bar relative to the other carriage.

11. A system for transferring a work piece between a first press station and a second press station in a multiple station transfer press having a plurality of associated upper and lower dies, the system comprising:

at least one cross bar assembly moveable between the press stations in the direction of flow for the transfer press;

each cross bar assembly having at least one cross bar;

a plurality of holding devices coupled to the one cross bar for removably engaging a work piece;

a transfer mechanism for moving the one cross bar assembly from a rest position to the first press station;

the cross bar assembly and the holding devices operable to releasably engage a work piece at the first press station and to move and deposit the work piece at the second press station;

the transfer mechanism returning the cross bar assembly to the rest position to prepare for a subsequent work piece transfer;

a first motor carded by the cross bar assembly for selectively rotating the one cross bar;

a plurality of sets of vacuum cups on the one cross bar, the vacuum cup sets operable to independently translate on the one cross bar; and a mechanical stop to limit rotation of the one cross bar between approximately thirty degrees in a clockwise direction and one hundred and eighty degrees in a counterclockwise direction.

12. A method of transferring work pieces in a multiple station transfer press having a plurality of press stations with associated upper and lower dies at each press station, a pair of transfer rails extending generally parallel with each other on opposite sides of the press stations and at least one cross bar assembly coupled with and extending between the transfer rails with each cross bar assembly having at least two cross bars and each cross bar having a plurality of holding devices extending therefrom, comprising the steps of:

moving the cross bar assembly from a rest position to a first press station containing a work piece which has been pressed by the associated upper and lower dies;

rotating at least one of the cross bars to position the holding devices extending from the one cross bar at a selected angular orientation relative to a longitudinal axis of the one cross bar;

engaging the work piece at the first press station with the holding devices having the selected angular orientation;

moving the cross bar assembly and the work piece from the first press station to a second press station;

depositing the work piece in the second press station;

separating the first and second cross bars on the cross bar assembly as the cross bar assembly enters the first pressed station; and closing together the first and second cross bars as the cross bar assembly exits the second press station.

13. The method of claim 12, wherein the step of rotating the cross bar further comprises the steps of:

identifying a first angular orientation of at least the one cross bar with an angle encoder; and rotating the one cross bar with an electrical motor until the angle encoder indicates that the one cross bar has been rotated to a desired, second angular orientation.

14. The method of claim 12, further comprising the steps of:

rotating each cross bar to position the holding devices extending from the respective cross bars at a respective selected angular orientation relative to a longitudinal axis for each of the cross bars;

engaging a first work piece with the respective holding devices of one of the cross bars; and engaging a second work piece with the respective holding devices of the other cross bar.

15. The method of claim 12, further comprising the step of rotating each cross bar to position the holding devices extending from the respective cross bars at a respective selected angular orientation relative to a longitudinal axis for each of the cross bars.

16. The method of claim 12, further comprising the step of rotating both cross bars to orient the work piece while moving the cross bar assembly from the first press station to the second press station.

17. The method of claim 12, further comprising the step of orienting the work piece by tilting the cross bar assembly relative to the pair of transfer rails.

18. The method of claim 12, further comprising the step of orienting the work piece by tipping the cross bar assembly relative to a direction of flow for moving the work piece through the transfer press.

19. The method of claim 12 further comprising the step of rotating the cross bar through a range of approximately plus or minus thirty degrees.

20. A method of transferring work pieces in a multiple station transfer press having a plurality of press stations with associated upper and lower dies at each press station and at least one cross bar assembly with each cross bar assembly at least two cross bars and each cross bar having a plurality of holding devices extending therefrom, comprising the step of:

moving the cross bar assembly from a rest position to a first press station containing a work piece which has been pressed by the associated upper and lower dies;

rotating at least one of the cross bars to position the holding devices extending from the one cross bar at a selected angular orientation relative to a longitudinal axis of the one cross bar;

engaging the work piece at the first press station with the holding devices having the selected angular orientation;

moving the cross bar assembly and the work piece from the first press station to a second press station;

depositing the work piece in the second press station;

raising and lowering first and second opposite transfer rails disposed parallel to the press stations and extending in a direction of flow for the work piece through the transfer press; and moving the cross bar assembly along the transfer rails while rotating the one cross bar.

21. A system for transferring a work piece in a multiple station transfer press having a plurality of associated upper and lower dies with an upper die and a lower die located at each press station, the system comprising:

first and second transfer rails disposed on opposite sides of the press stations and extending generally parallel to a direction of flow for the work piece through the transfer press;

a plurality of cross bar assemblies movably coupled to and extending between the transfer rails;

a pair of cross bars associated with each cross bar assembly extending between the transfer rails generally perpendicular to the direction of flow;

each cross bar assembly having a pair of carriages with one of the carriages movably coupled on one of the transfer rails and the other carriage movably coupled on the other transfer rail;

one end of each cross bar coupled with one of the respective pair of carriages and the other end of each cross bar coupled with the other of the respective pair of carriages;

a plurality of holding devices attached to each of the cross bars for releasably engaging a work piece for movement of the work piece between adjacent press stations; and a first servo motor and a second servo motor carried by each cross bar assembly and attached respectively to one end of each cross bar to rotate each cross bar independent from the other cross bar.

22. The system of claim 21, and further comprising a first angle encoder and a second angle encoder attached respectively to each of the cross bars to provide a signal indicating the angular orientation of the respective cross bar.

23. The system of claim 21, and further comprising:

a first beating assembly for rotatably coupling the other end of one of the cross bars with one of the carriages; and a second beating assembly for rotatably coupling the other end of the other cross bar with the one carriage.

24. The system of claim 21, wherein the holding devices comprise vacuum cups and rotation of each cross bar by the respective first servo motor and second servo motor varies the angular orientation of the respective vacuum cups relative to a longitudinal axis of the respective cross bar.

25. The system of claim 21, wherein the holding devices comprise:

two sets of vacuum cups coupled to the cross bar, the vacuum cup sets operable to independently translate on the cross bar; and a first mechanical stop and a second mechanical stop attached respectively to one of the cross bars to limit rotation of the respective cross bar to less than three hundred and sixty degrees in either a clockwise direction or a counterclockwise direction.

26. The system of claim 21, and further comprising a first mechanical stop and a second mechanical stop attached respectively with one of the cross bars to limit rotation of the respective cross bar to less than three hundred and sixty degrees relative to a longitudinal axis of the respective cross bar.

27. The system of claim 21, further comprising:

the first servo motor and the second servo motor attached to one of the carriages;

a first bearing assembly for rotatably coupling the other end of one of the cross bars with the other carriage; and a second bearing assembly for rotatably coupling the other end of the other cross bar with the other carriage.

28. A method of changing dies in a multiple station transfer press having a plurality of press stations with upper and lower dies at each press station, a pair of transfer rails with a plurality of cross bar assemblies extending between the transfer rails and each cross bar assembly having at least one cross bar rotatably mounted thereon with a plurality of holding devices attached to and extending from the cross bar, the method comprising the steps of:

rotating each cross bar approximately one hundred and eighty degrees from a first, normal operating position in which the attached holding devices may be releasably engaged with a work piece to a second position allowing replacement of the attached holding devices;

raising the pair of transfer rails from a first operating position to a second position which allows removal of the lower dies;

replacing the upper and lower dies at a press station; and replacing the holding devices on the cross bar assemblies associated with the press station.

29. The method of claim 28, further comprising the steps of:

rotating each cross bar from its second position to its first, normal operating position; and lowering the pair of transfer rails from their second position to their first, normal operating position.

* * * * *